US009402433B2

(12) United States Patent
York

(10) Patent No.: US 9,402,433 B2
(45) **Date of Patent: *Aug. 2, 2016**

(54) VISOR IMPROVEMENTS

(71) Applicant: Foamula Products, Inc., Wellington, FL (US)

(72) Inventor: Daniel T. York, N. Palm Beach, FL (US)

(73) Assignee: Foamula Products, Inc., Wellington, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,640

(22) Filed: Jan. 9, 2015

(65) Prior Publication Data

US 2015/0181971 A1 Jul. 2, 2015

Related U.S. Application Data

(60) Continuation-in-part of application No. 14/279,994, filed on May 16, 2014, now Pat. No. 9,215,902, which is a division of application No. 13/690,881, filed on Nov. 30, 2012, now Pat. No. 8,763,163, application (Continued)

(51) Int. Cl.
*A42B 1/18* (2006.01)
*A41D 27/08* (2006.01)
(Continued)

(52) U.S. Cl.
CPC ... *A42B 1/22* (2013.01); *A42B 1/18* (2013.01); *A42B 1/24* (2013.01)

(58) Field of Classification Search
CPC ..... A42B 1/248; A42B 1/24; A42B 1/004; A42B 1/064; A42B 1/062; A42B 1/02; A42B 1/061; A42B 1/18; A42B 1/247; A42B 3/0406; A42B 1/067; A42B 1/068; A42B 1/205; A42B 1/241; A42B 1/244; A42B 3/02; A41D 2400/70; Y10S 2/918; Y10S 2/11; Y10S 2/909; G09F 21/02; G09F 2021/023; G09F 3/16; G09F 7/00; A44B 1/04; A44B 1/14; A44B 17/0047; A44B 1/32; A44C 3/001; A44C 25/007; A44C 5/00
See application file for complete search history.

(56) References Cited

U.S. PATENT DOCUMENTS 104,652 A 6/1870 Scribner
729,500 A 5/1903 Mahony
(Continued)

FOREIGN PATENT DOCUMENTS

JP 2010229609 10/2010

OTHER PUBLICATIONS

Vizers Group, LLC, PCT Application No. PCT/US2013/069220 filed Nov. 8, 2013, Notification Concerning Transmittal of International Preliminary Report on Patentability mailed Jun. 11, 2015, 10 pages.
(Continued)

*Primary Examiner* — Bobby Muromoto, Jr.
(74) *Attorney, Agent, or Firm* — Brian S. Steinberger; Law Offices of Brian S. Steinberger, P.A.

(57) ABSTRACT

Visors and methods of using a soft type foam visor having a brim and headband formed from a pliable and flexible material, such as but not limited to EVA which includes ethylene vinyl acetate, with or without patterns of through-holes and partial cutouts for allowing accessories such as labels, charms, badges, puncture tool and sunglass/eyeglass supports and the like, to be plugged into the holes and cut-outs and easily removable and interchangeable with other accessories. A removable rear head strap be attached to the visor, having a plurality of holes with fasteners to adjust the strap to different head sizes.

20 Claims, 28 Drawing Sheets

Related U.S. Application Data

No. 14/593,640, which is a continuation-in-part of application No. 29/477,813, filed on Dec. 27, 2013, now Pat. No. Des. 749,303.

(60) Provisional application No. 61/565,627, filed on Dec. 1, 2011.

(51) Int. Cl.

| | |
|---|---|
| ***A42B 1/22*** | (2006.01) |
| ***A42B 1/24*** | (2006.01) |
| *A42B 1/00* | (2006.01) |
| *A41D 27/00* | (2006.01) |

(56) References Cited

U.S. PATENT DOCUMENTS

| | | | |
|---|---|---|---|
| 757,854 | A | 4/1904 | Wickersham |
| 1,190,427 | A | 7/1916 | Kromer |
| 1,435,533 | A | 11/1922 | Knackstedt |
| 1,452,305 | A | 4/1923 | Mahony |
| 1,506,815 | A | 12/1923 | Cormay |
| 1,624,727 | A | 1/1927 | Goldberg |
| 1,782,206 | A | 3/1928 | Kornsweet |
| 2,160,513 | A | 1/1937 | Pasternak |
| 2,406,598 | A | 8/1946 | Flood |
| 2,748,517 | A | 9/1953 | Berkis |
| 2,908,012 | A | 10/1959 | Feldman |
| 2,968,812 | A | 1/1961 | Vivolo |
| 3,484,974 | A | 12/1969 | Culmone |
| 3,491,374 | A | 1/1970 | Frangos |
| 3,551,911 | A | 1/1971 | Holden |
| 3,849,839 | A | 11/1974 | Zimber |
| 4,168,542 | A | 9/1979 | Small |
| 4,292,689 | A | 10/1981 | Townsend, Jr. |
| D266,712 | S | 11/1982 | Van Valkenburgh |
| 4,507,344 | A | 3/1985 | Baughman |
| 4,551,860 | A | 11/1985 | Smit |
| D282,308 | S | 1/1986 | Kain |
| 4,611,355 | A | 9/1986 | Galanto |
| 4,612,672 | A | 9/1986 | Schrack |
| 4,736,469 | A | 4/1988 | Boretti |
| 4,776,043 | A | 10/1988 | Coleman |
| 4,837,960 | A | 6/1989 | Skaja |
| 4,845,786 | A | 7/1989 | Chiarella |
| 4,873,726 | A | 10/1989 | Tapia |
| 4,918,758 | A | 4/1990 | Rendina |
| 5,003,640 | A | 4/1991 | Pizzacar |
| 5,070,545 | A | 12/1991 | Tapia |
| 5,117,506 | A | 6/1992 | Byrnes |
| 5,136,726 | A | 8/1992 | Kellin |
| 5,142,706 | A | 9/1992 | Layhon |
| 5,276,985 | A | 1/1994 | Halloran |
| 5,282,278 | A | 2/1994 | Miner |
| D345,447 | S | 3/1994 | Lapsker |
| 5,328,399 | A | 7/1994 | Reynolds |
| 5,359,734 | A | 11/1994 | Rathburn |
| 5,410,761 | A | 5/1995 | Connelly |
| 5,418,981 | A | 5/1995 | Miner |
| 5,428,842 | A | 7/1995 | Wise |
| 5,437,064 | A | 8/1995 | Hamaguchi |
| 5,442,817 | A | 8/1995 | Miner |
| 5,452,479 | A | 9/1995 | Mostert |
| 5,477,629 | A | 12/1995 | Gleason, Jr. |
| 5,509,144 | A | 4/1996 | Soergel |
| 5,510,961 | A | 4/1996 | Peng |
| 5,647,060 | A | 7/1997 | Lee |
| 5,673,501 | A | 10/1997 | Mathews |
| 5,713,083 | A | 2/1998 | King |
| 5,718,559 | A | 2/1998 | Freund |
| 5,734,991 | A | 4/1998 | Schmid |
| 5,742,944 | A | 4/1998 | Pfefferman |
| D394,136 | S | 5/1998 | Richlin |
| 5,754,983 | A | 5/1998 | Landers |
| 5,773,118 | A | 6/1998 | Eisenpresser |
| 5,790,988 | A | 8/1998 | Guadagnino |
| 5,794,267 | A | 8/1998 | Wallace |
| 5,803,266 | A | 9/1998 | Blackwelder |
| 5,826,278 | A | 10/1998 | King |
| 5,839,211 | A | 11/1998 | Pallera |
| 5,845,334 | A | 12/1998 | Marcolini |
| 5,887,287 | A | 3/1999 | Potochnik |
| D410,134 | S | 5/1999 | Wolken |
| 5,901,370 | A | 5/1999 | Linday |
| 5,901,381 | A | 5/1999 | Nelson |
| 5,983,400 | A | 11/1999 | Kronenberger |
| 6,012,203 | A | 1/2000 | Baron Pearson |
| 6,038,702 | A | 3/2000 | Knerr |
| 6,038,704 | A | 3/2000 | Crescentini |
| 6,044,495 | A | 4/2000 | Ellman |
| 6,158,054 | A | 12/2000 | Perry, Sr. |
| 6,161,224 | A | 12/2000 | Tuetken |
| 6,175,963 | B1 | 1/2001 | Loeffelholz |
| 6,237,159 | B1 | 5/2001 | Martin |
| 6,256,794 | B1 | 7/2001 | Erickson |
| 6,279,167 | B1 | 8/2001 | Johnson |
| 6,305,028 | B1 | 10/2001 | Lin |
| 6,317,896 | B1 | 11/2001 | Timms |
| 6,341,380 | B1 | 1/2002 | Coleman |
| 6,349,415 | B1 | 2/2002 | Gong |
| D457,298 | S | 5/2002 | Rowland |
| 6,381,754 | B1 | 5/2002 | Ezenekwe |
| 6,389,608 | B1 | 5/2002 | Williams |
| D460,604 | S | 7/2002 | Sullivan, Jr. |
| 6,412,151 | B1 | 7/2002 | Rowland |
| 6,460,193 | B1 | 10/2002 | DiPalma |
| 6,513,167 | B1 | 2/2003 | Cheng |
| 6,519,779 | B1 | 2/2003 | Taguchi |
| 6,675,512 | B1 | 1/2004 | Shwartz |
| 6,718,559 | B1 | 4/2004 | Davidson |
| 6,769,139 | B1 | 8/2004 | Goldkind |
| 6,802,140 | B2 | 10/2004 | Aslanides |
| D501,705 | S | 2/2005 | Hathaway |
| 6,993,858 | B2 | 2/2006 | Seamans |
| D517,789 | S | 3/2006 | Seamans |
| 7,089,691 | B1 | 8/2006 | Silvera |
| D530,486 | S | 10/2006 | Ruttan |
| 7,178,364 | B2 | 2/2007 | Shapiro |
| 7,182,478 | B2 | 2/2007 | Marston |
| 7,200,959 | B2 | 4/2007 | Spann |
| D543,014 | S | 5/2007 | Sharpe |
| D545,032 | S | 6/2007 | Wolf |
| D545,033 | S | 6/2007 | Wolf |
| 7,243,377 | B2 | 7/2007 | Ashy |
| D558,955 | S | 1/2008 | Taylor |
| D566,904 | S | 4/2008 | Verhaeghe |
| D567,483 | S | 4/2008 | Liow |
| 7,350,274 | B2 | 4/2008 | Rogers |
| D571,082 | S | 6/2008 | Kelleghan |
| 7,389,567 | B2 | 6/2008 | Rogers |
| D579,606 | S | 10/2008 | Scholl |
| D592,835 | S | 5/2009 | Wilson |
| D593,285 | S | 6/2009 | Olivo |
| D601,329 | S | 10/2009 | Johns |
| D603,584 | S | 11/2009 | Porter |
| D604,484 | S | 11/2009 | Lauro |
| D606,288 | S | 12/2009 | Thorne |
| 7,640,636 | B2 | 1/2010 | Clark |
| 7,698,836 | B2 | 4/2010 | Schmelzer |
| D618,128 | S | 6/2010 | Clark |
| D619,336 | S | 7/2010 | Eyl |
| D620,235 | S | 7/2010 | Kronenberger |
| 7,765,618 | B2 | 8/2010 | Egglesfield |
| D625,052 | S | 10/2010 | Mastoras |
| 7,891,117 | B2 | 2/2011 | Sack |
| 8,001,661 | B2 | 8/2011 | Clark |
| 8,011,206 | B2 | 9/2011 | Imai |
| 8,069,538 | B2 | 12/2011 | Wilcox |
| D654,052 | S | 2/2012 | Lee |
| 8,112,963 | B2 | 2/2012 | Johnson |
| 8,122,519 | B2 | 2/2012 | Schmelzer |
| D672,535 | S | 12/2012 | Phan |
| 8,443,971 | B1 | 5/2013 | Green |
| 8,453,267 | B1 | 6/2013 | Stanley |

(56) References Cited

U.S. PATENT DOCUMENTS

| | | | | |
|---|---|---|---|---|
| 8,617,683 | B2 | 12/2013 | Johnson | |
| 8,627,516 | B2 | 1/2014 | Evans | |
| 8,763,163 | B1 * | 7/2014 | Johns | A42B 1/004 2/195.1 |
| 9,215,902 | B2 * | 12/2015 | Johns | A42B 1/004 |
| 2002/0118533 | A1 | 8/2002 | Marston | |
| 2004/0019953 | A1 | 2/2004 | Galimant | |
| 2004/0034903 | A1 | 2/2004 | Blair | |
| 2004/0093658 | A1 | 5/2004 | Jackson | |
| 2004/0117894 | A1 | 6/2004 | Kuo | |
| 2005/0198725 | A1 | 9/2005 | Mollo | |
| 2005/0273906 | A1 | 12/2005 | Kim | |
| 2006/0007668 | A1 | 1/2006 | Chien | |
| 2006/0152671 | A1 | 7/2006 | Risso | |
| 2007/0006502 | A1 | 1/2007 | Schmelzer | |
| 2007/0084019 | A1 | 4/2007 | Wilcox | |
| 2008/0060110 | A1 | 3/2008 | Schmelzer | |
| 2008/0141440 | A1 | 6/2008 | Taylor | |
| 2008/0263839 | A1 | 10/2008 | Stillwell | |
| 2009/0025113 | A1 | 1/2009 | Kelleghan | |
| 2009/0101162 | A1 | 4/2009 | Hsu | |
| 2010/0064419 | A1 | 3/2010 | Lee | |
| 2010/0229609 | A1 | 9/2010 | Bergmann | |
| 2011/0078843 | A1 | 4/2011 | Kennedy | |
| 2011/0094015 | A1 | 4/2011 | Braun | |
| 2012/0304691 | A1 | 12/2012 | Braun | |
| 2013/0318688 | A1 | 12/2013 | Cherin | |
| 2014/0137311 | A1 | 5/2014 | Sandoval | |

OTHER PUBLICATIONS

Vizers Group, LLC, International Search Report mailed Feb. 24, 2014 for serial No. PCT/US2013/069220 filed on Nov. 8, 2013, 13 pages.

Jibbitz, Create Your Story, Jibbitz Shoe Charms, Crocs., Inc., online, 2012, http://www.crocs.comcrocs-jibbitz-compatible-crocs/jibbitz-compatible-crocs, defaults, sc . . . , 1 page.

Logo Mark, Headwear, Vizers Group, LLC, Trademark Registration filed Jan. 22, 2014, http://www.tradennarkia.com/logo-86171739.html, 3 pages.

Vizers at Surf Expo, posted on Facebook Sep. 13, 2013, https://www.facebook.com/myvizer/photos/pb.608478422509824.-2207520000.1439302702./647962368561429/?type=3&theatre, 1 page.

Vizers Hats Designed Specially for Attractions, Sea Thoughts, LLC, Feb. 15, 2013, http://www.attractionsmanagennent.com/detail.cfm?Pagetype=detail&subject=product&codeID=304930, 1 page.

Vizers, Soft—Coloful—Comfortable . . . and they Float!, Mar. 15, 2012, https://web.archive.org/web/20120315105657//http://www.vizers.com/, 1 page.

* cited by examiner

VISOR IMPROVEMENTS

RELATED APPLICATIONS

This application is a Continuation in Part of U.S. patent application Ser. No. 14/279,994 filed May 16, 2014, which is a Divisional of U.S. patent application Ser. No. 13/690,881 filed Nov. 30, 2012, now U.S. Pat. No. 8,763,163, which claims the benefit of priority to U.S. Provisional Patent Application Ser. No. 61/565,627 filed Dec. 1, 2011, and this application is a Continuation In Part of U.S. patent application Ser. No. 29/477,813 filed Dec. 27, 2013. The entire disclosure of each of the applications listed in this paragraph are incorporated herein by specific reference thereto.

FIELD OF INVENTION

This invention relates to hats and caps, in particular to head visor assemblies, apparatus, and methods of making a soft type foam visor with or without partial or full through-hole shaped openings, such as but not limited to geometrical shapes, letters, characters, and the like, that allow for accessories such as labels, charms, badges, sunglasses, and the like, to be plugged into the openings and easily removable and interchangeable with other accessories, with a headband and brim formed from or molded from an odorless EVA material that is water proof, floats in water, anti-bacterial, have good clarity and gloss, barrier properties, low-temperature toughness, stress-crack resistance, hot-melt adhesive, and resistance to UV (ultra violet) radiation.

BACKGROUND AND PRIOR ART

Sun visors have become a popular type of headgear for keeping the sun off the face of the wearer. Often the visors are formed from a cloth or fabric type material with a fixed band. Other types of well known visors are formed from a hard plastic with rearwardly extending curved bands which wrap about part of the head of the wearer.

A problem with these prior art visors is that indicia (such as but not limited to advertisements, etc.) must be permanently fixed thereon. For example, sewing a label on a cloth or fabric visor is well known, but the label is not easily removable.

Painting indicia with markers and the like, can also be done on prior art visors, but the paint is also generally permanent. Peel and stick decals can also be used, but they are also intended to be permanent and are not intended to be easily removed or changed.

Using a hook and loop fastener, such as Velcro®, can also be used, but at least one side of the hook and loop fastener, must also be permanently attached to a surface of the visor.

Caps and visors have been made over the years with holes. See for example, U.S. Pat. No. 1,782,206 to Kornsweet; U.S. Pat. No. D460,604 to Sullivan; U.S. Pat. No. D601,329 to Johns, the latter being the inventor of the subject invention. However, the holes were used for ventilation and/or decoration, and were not useful for mounting and supporting indicia thereon.

Thus, the need exists for solutions to the above problems with the prior art.

SUMMARY OF THE INVENTION

A primary objective of the present invention is to provide head visor devices, apparatus, and methods of using a soft type foam visor with or without patterns of partial and/or full cutout hole openings that allow for accessories such as labels, charms, badges, and the like, to be plugged into the openings and easily removable and interchangeable with other accessories.

A secondary objective of the present invention is to provide head visor devices, apparatus, and methods of using a soft type foam visor with or without patterns of partial and/or full cutout hole openings that allow for accessories such as labels, charms, badges, and the like, to be easily removable and interchangeable with other accessories.

A third objective of the present invention is to provide head visor devices, apparatus, and methods of using a soft type foam visor with or without patterns of partial and/or complete throughhole openings that allow for accessories, having an adjustable head strap that is also removable.

A fourth objective of the present invention is to provide head visor devices, apparatus, and methods of using a soft type foam visor with or without patterns of partial and/or complete throughhole openings with a puncture tool that can turn partial cutouts into throughhole cutouts to mount accessories thereon.

A fifth objective of the present invention is to provide head visor devices, apparatus, and methods of using a soft type foam visor with or without patterns of partial and/or complete throughhole openings having different shapes, such as but not limited to different geometrical shapes, letter shapes, character shapes, and the like, in order to mount accessories thereon.

A sixth objective of the present invention is to provide head visor devices, apparatus, and methods of using a soft type foam visor with without patterns of partial and/or complete throughhole openings that allow for accessories such as adapters to be able to mount sunglasses/eyeglasses to the visor.

A seventh object of the invention is to provide head visor devices, apparatus, and methods of forming a visor with a headband and brim formed from or molded from a soft plastic, such as but not limited to EVA (ethylene vinyl acetate).

An eighth object of the invention is to provide head visor devices, apparatus, and methods of forming a visor with a headband and brim formed from or molded from material that is water proof, floats in water, anti-bacterial, have good clarity and gloss, barrier properties, low-temperature toughness, stress-crack resistance, hot-melt adhesive, and resistance to UV (ultra violet) radiation. EVA has little or no odor and is competitive with rubber and vinyl products in cost.

An embodiment can be formed from a flexible and pliable material, a plurality of slot shapes on a front surface portion of the visor with headband, at least one accessory having a male member that mateably attaches into at least one of the slots, wherein the accessory is both attachable and detachable from the visor with headband.

The visor assembly can include a removable strap having ends that are attachable to left and right portions of the headband, the removable strap being formed from the flexible and pliable material. The removable strap can include rivet members having inwardly protruding portions for being insertable into a plurality of adjustment holes in the removable strap. The visor material can be EVA (ethylene vinyl acetate).

The accessory can include a logo plate, having indicia across a front surface of the logo plate, and/or a decorative charm.

The slot shapes can include circular shapes, noncircular geometrical shapes, outline shapes of different characters and objects.

The slot shapes can include through-hole cutouts through the visor, and/or partial cutouts through only a surface portion of the visor.

A puncture tool can be included for puncturing a partial-cutout into a through-hole cutout. An adapter can be used for attaching sunglasses/eyeglasses to the visor assembly.

A visor assembly kit, can include the combination of a visor with headband formed from a flexible and pliable material, a plurality of both through-hole slots and partial cut-out slots along a front surface portion of the visor with headband, a removable strap having ends that are attachable to left and right portions of the headband, the removable strap being formed from the flexible and pliable material, and a plurality of accessories, each accessory having a male member that mateably attaches into at least one of the through-hole slots and partial cut-out slots, wherein the accessories are both attachable and detachable from the visor with headband, and wherein the accessories are selected from the group consisting of logo plates and decorative charms and a puncture tool to punch out a partial cutout, and an adapter for mounting sunglasses/eyeglasses to the visor assembly. The plurality of both through-hole slots and partial cut-out slots, can include different shapes, such as different geometrical shapes, letters, character outlines.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
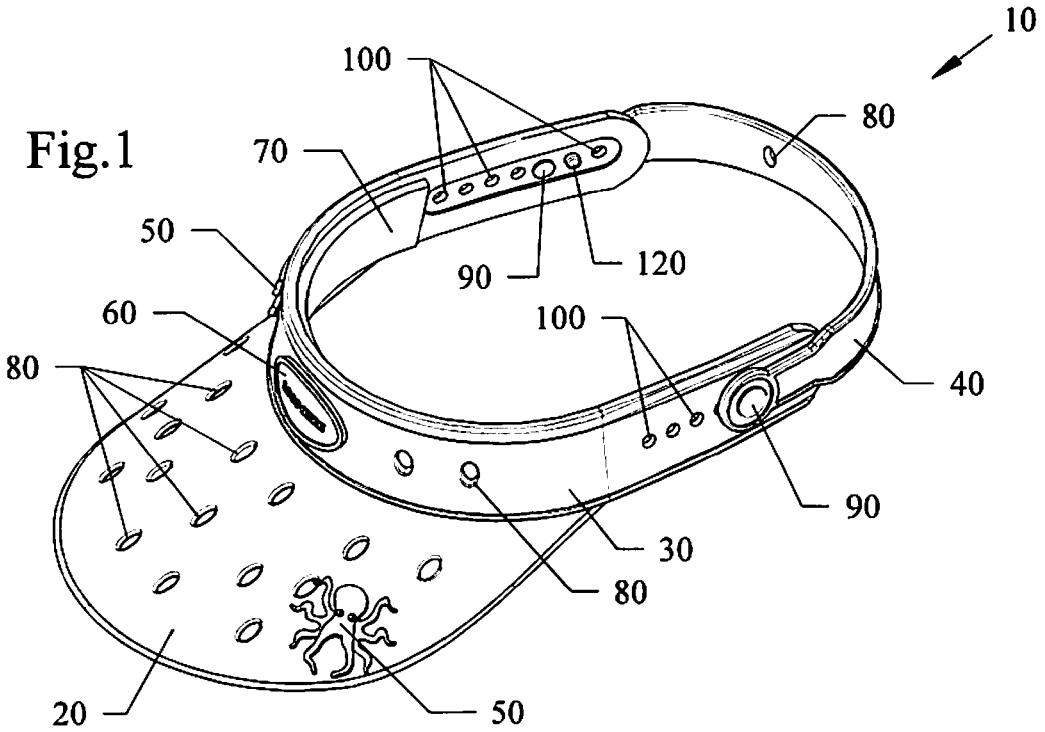
FIG. 1 is a top perspective view of the novel visor assembly.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

10 visor assembly.
20 Visor/brim.
30 Headband.
40 Back band.
50 Snap-in charm.
60 Snap-in logo plate.
70 Sweat band.
80 Through-hole cutouts and/or partial cut-outs for charms and logo plate.
90 Back band rivet.
100 Back band adjustment holes in headband.
110 Rivet hole in back band.
120 Back band alignment stud.
130 Studs to secure logo plate and charms into cutouts.
140. Puncture tool
142. front of tool
144. raised gripping surface
145. puncture tip
147. stem
148. stud/rear wall
150. visor assembly with different shaped cutouts
152. letter shaped cutout
154. star shaped cutout
158. half moon shaped cutout
160. visor assembly with more different shaped cutouts
162. triangle shaped cutout
164. rectangular/square shaped cutout
166. cartoon character shaped cutout
170. adapter for eyeglasses/sunglasses
172. front wall of adapter
174. curved hook
175. stem
178. stud/rear wall
180. eyeglasses/sunglasses
182. arm(s)
190. visor assembly for eyeglasses/sunglasses
200, Visor Assembly Second Embodiment
220 brim
222 outer side rim
224 outer front rim
226 rear raised edge (lower raised rim on the front headband)
230 front head band
232 upper side rim
234 upper front rim
236 lower side rim
240 back (rear) band
242 upper raised rim
244 lower raised rim
246 circular end with raised rim
270 sweat band
280 openings/sockets in front head band
290 rivets
300, Visor Assembly Third Embodiment
320 brim
322 outer side rim
324 outer front rim
326 rear raised edge
330 front head band
332 upper side rim
334 upper front rim
336 lower side rim
340 back (rear) band
342 upper raised rim
344 lower raised rim
346 circular end with raised rim
370 sweat band
390 rivets The assignee of the subject application is also the assignee on U.S. Design Pat. No. D601,329 to Johns, which is incorporated by reference in its' entirety.

Figure 2:
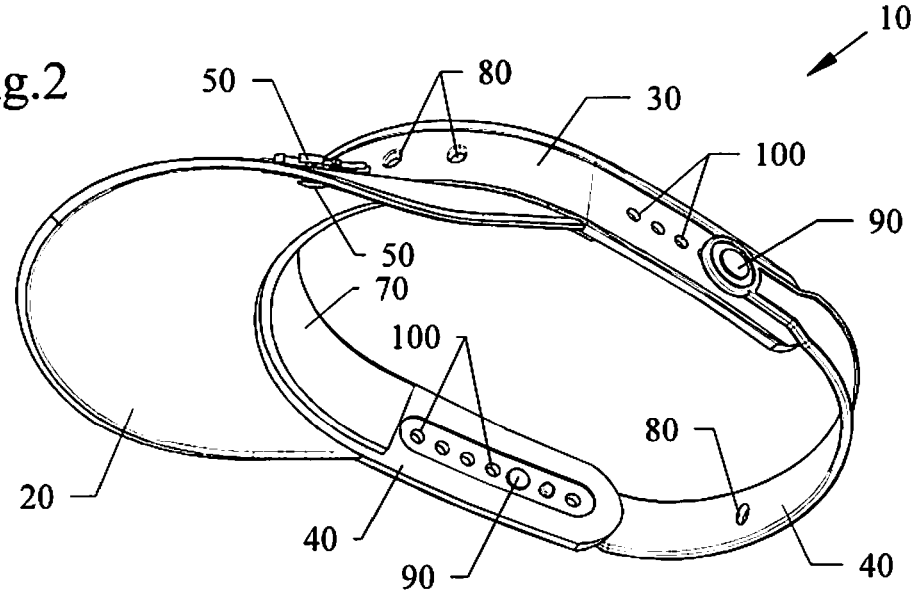
FIG. 2 is a bottom perspective of the visor assembly of FIG. 1.
Figure 3:
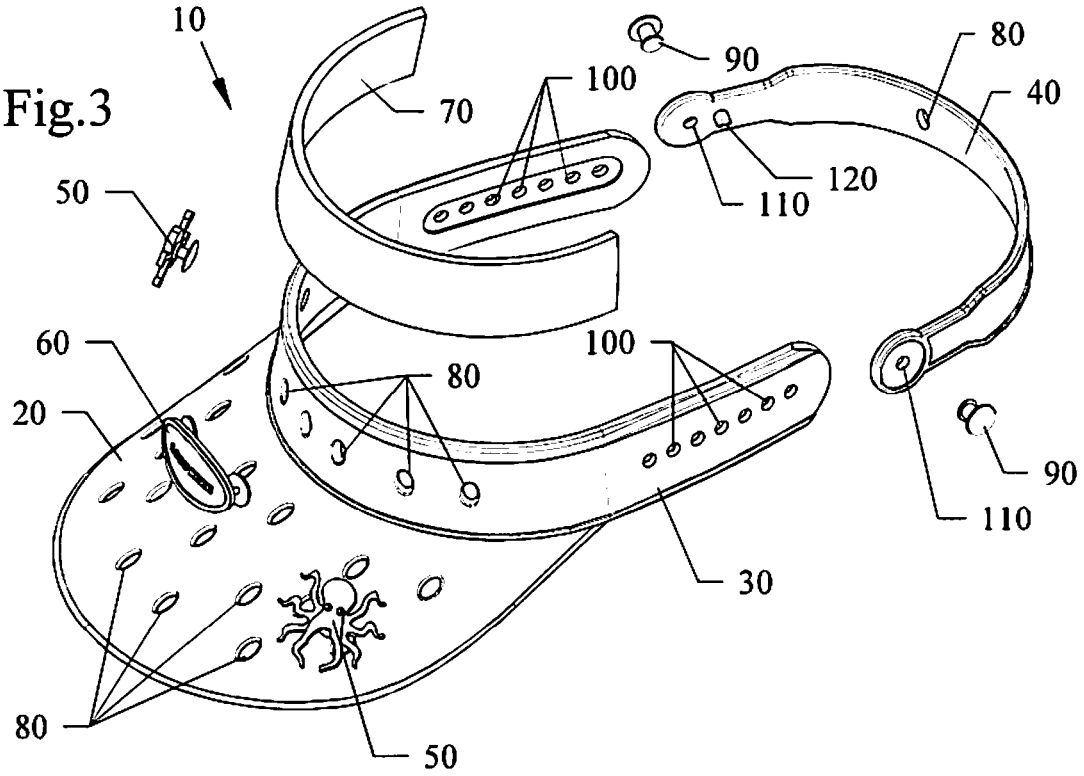
FIG. 3 is a top exploded perspective view of the visor assembly of FIG. 1.
Figure 4:
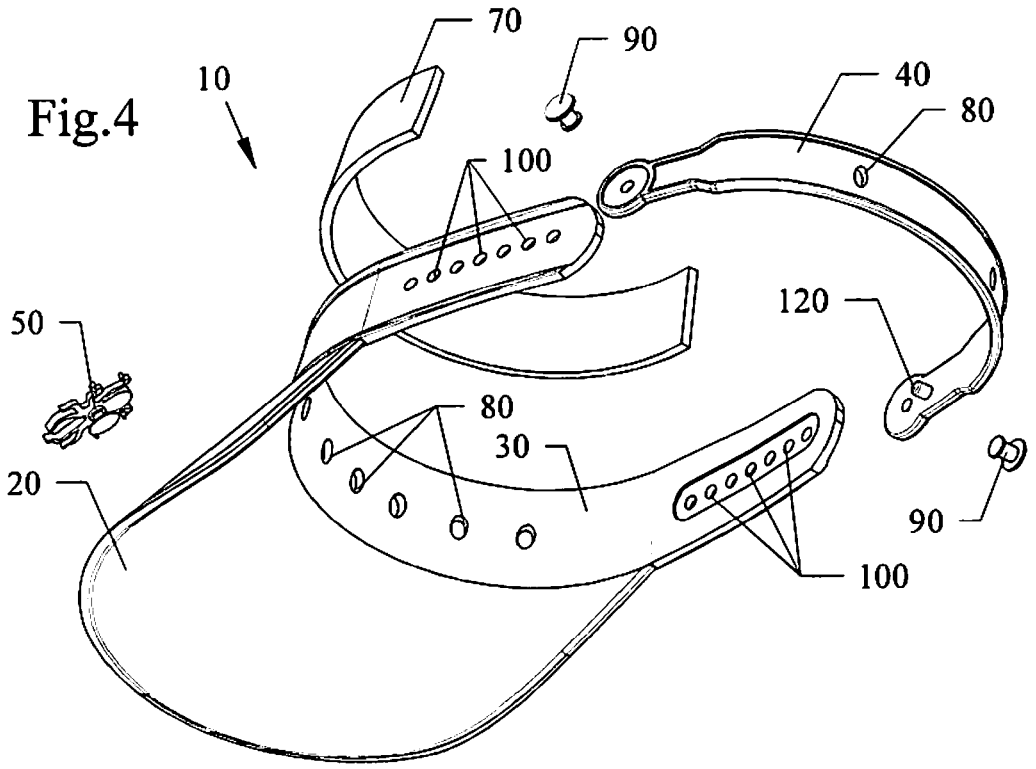
FIG. 4 is a bottom exploded perspective view of the visor assembly of FIG. 3

FIG. 1 is a top perspective view of the novel visor assembly 10. FIG. 2 is a bottom perspective of the visor assembly 10 of FIG. 1. FIG. 3 is a top exploded perspective view of the visor assembly 10 of FIG. 1. FIG. 4 is a bottom exploded perspective view of the visor assembly 10 of FIG. 3 FIG. 5 is a top view of the visor assembly 10 of FIG. 1.

Figure 5:
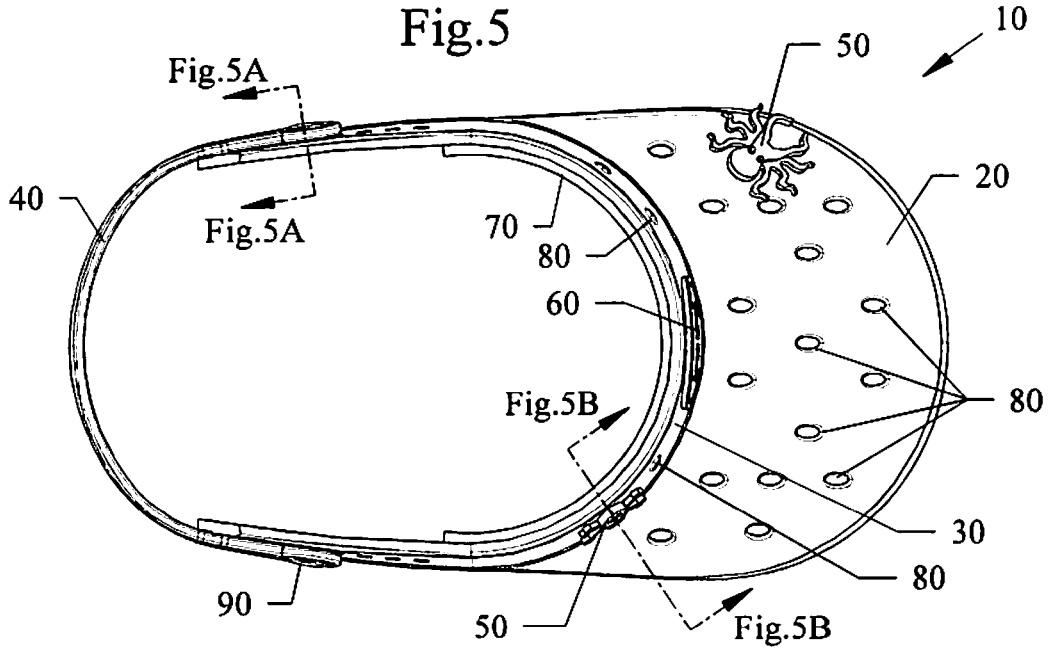
FIG. 5 is a top view of the visor assembly of FIG. 1.
Figure 5A:
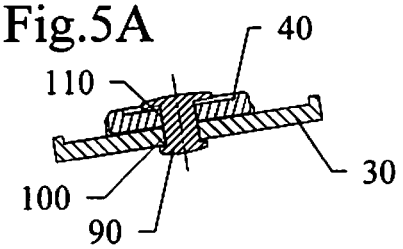
FIG. 5A is a cross-sectional view of the band rivet connection of FIG. 5 along arrow 5A.

FIG. 5A is a cross-sectional view of the band rivet connection of FIG. 5 along arrow 5A.

Figure 5B:
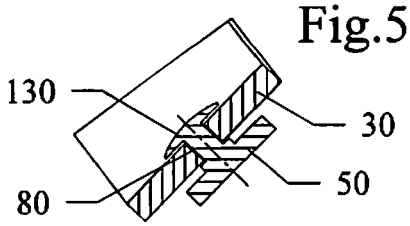
FIG. 5B is a cross-sectional view of the charm connection of FIG. 5 along arrow 5B.

FIG. 5B is a cross-sectional view of the charm connection of FIG. 5 along arrow 5B.

Figure 6:
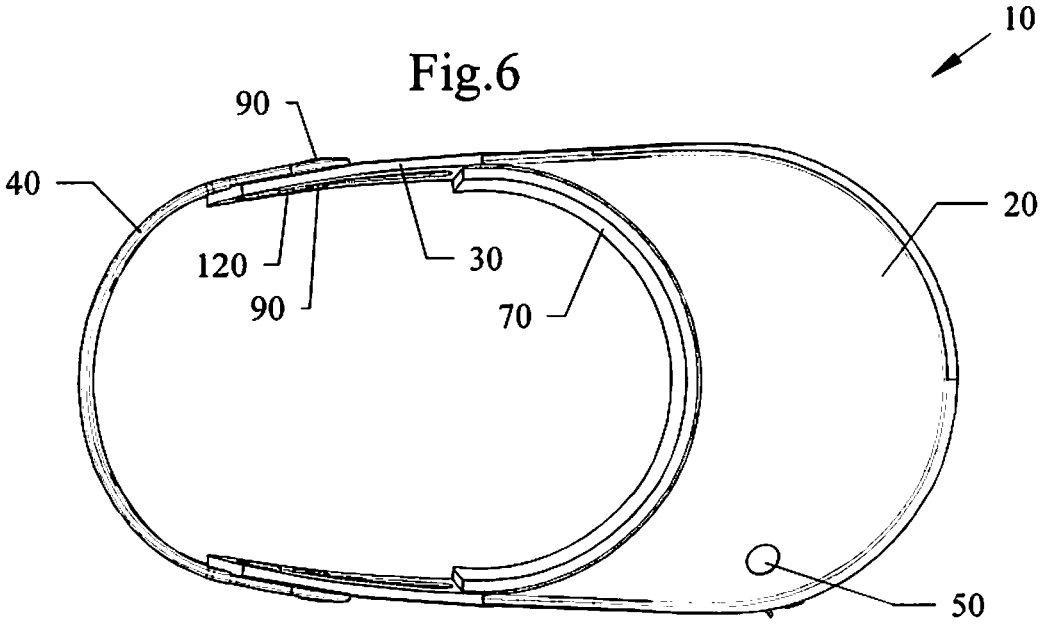
FIG. 6 is a bottom view of visor assembly of FIG. 5.
Figure 7:
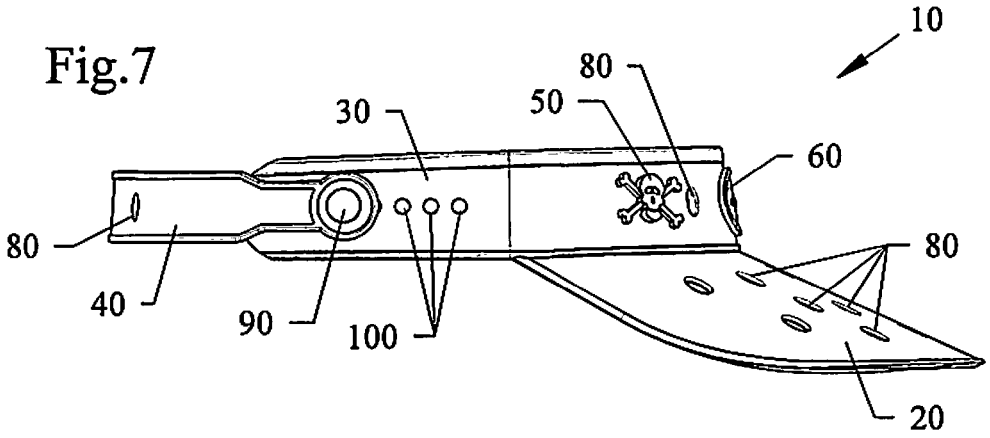
FIG. 7 is a right side view of the visor assembly of FIGS. 5-6.
Figure 8:
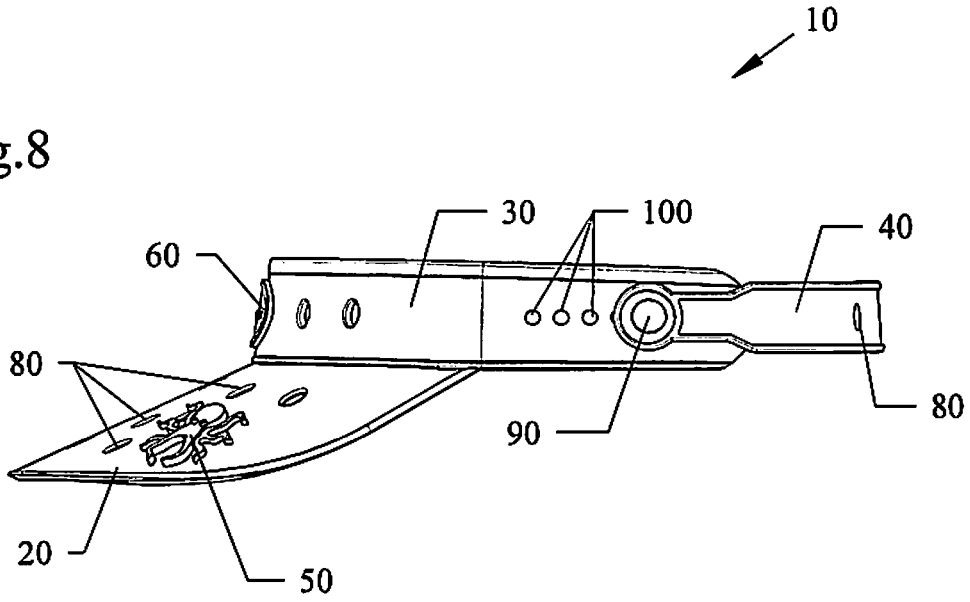
FIG. 8 is a left side view of the visor assembly of FIGS. 5-6.
Figure 9:
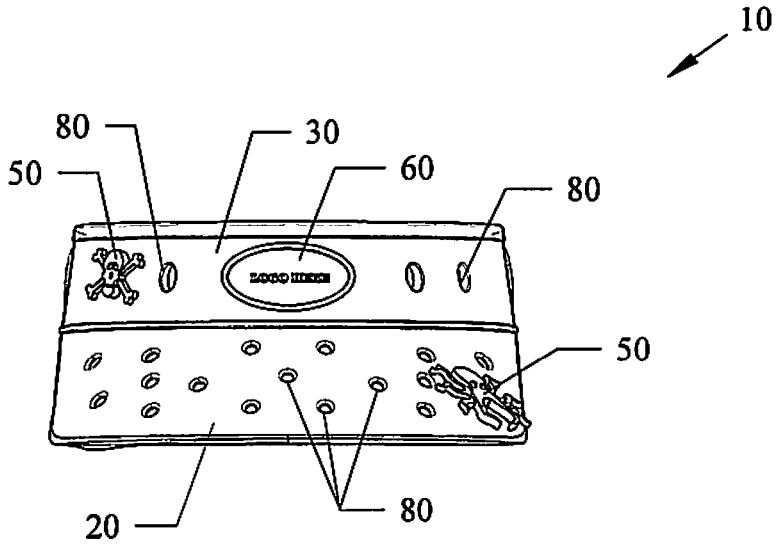
FIG. 9 is a front side view of the visor assembly of FIGS. 5-8.
Figure 10:
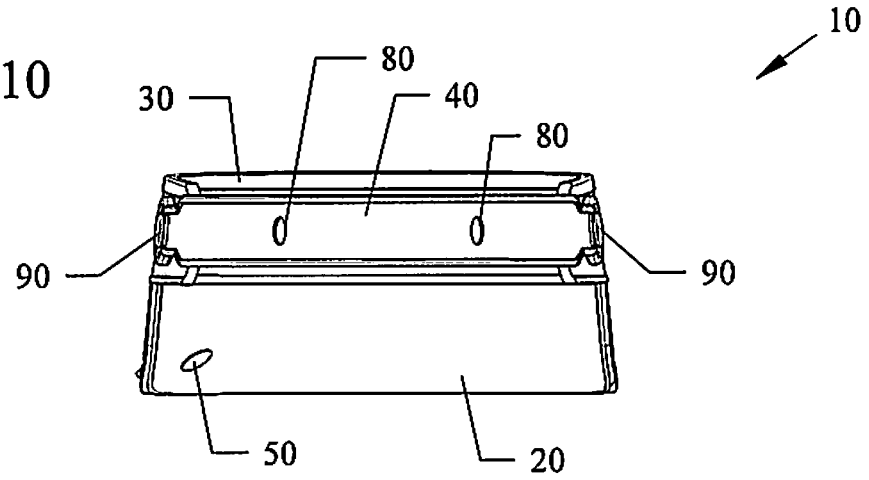
FIG. 10 is a rear side view of the visor assembly of FIGS. 5-8.

FIG. 6 is a bottom view of visor assembly 10 of FIG. 5. FIG. 7 is a right side view of the visor assembly 10 of FIGS. 5-6. FIG. 8 is a left side view of the visor assembly 10 of FIGS. 5-6. FIG. 9 is a front side view of the visor assembly 10 of FIGS. 5-8. FIG. 10 is a rear side view of the visor assembly 10 of FIGS. 5-8.

Figure 11:
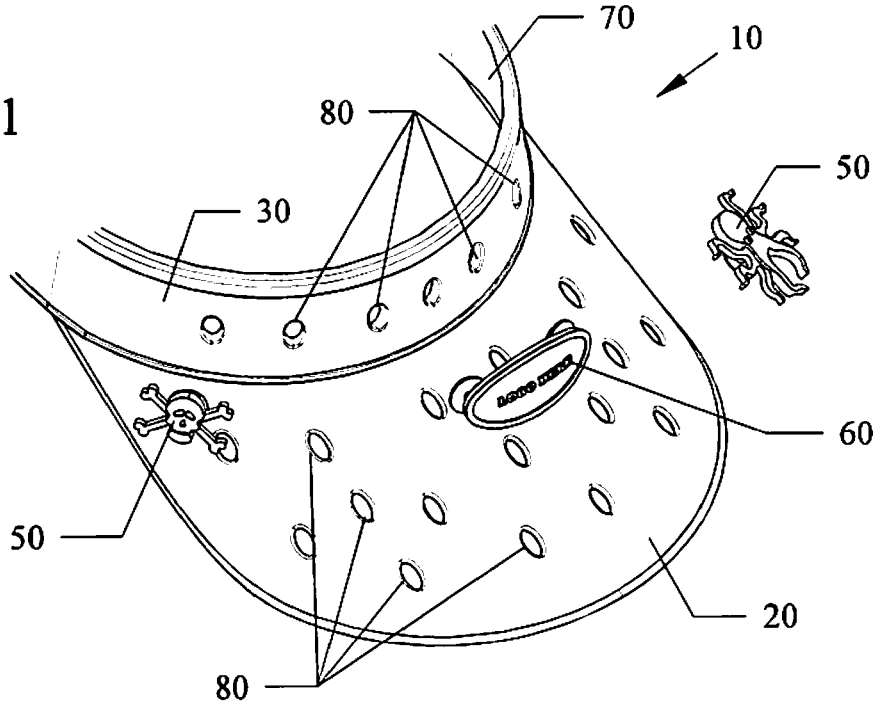
FIG. 11 is a top front perspective view of the visor assembly of the preceding figures showing logo plate and charm ready to be installed.

FIG. 11 is a top front perspective view of the visor assembly 10 of the preceding figures showing logo plate and charm ready to be installed.

Figure 12:
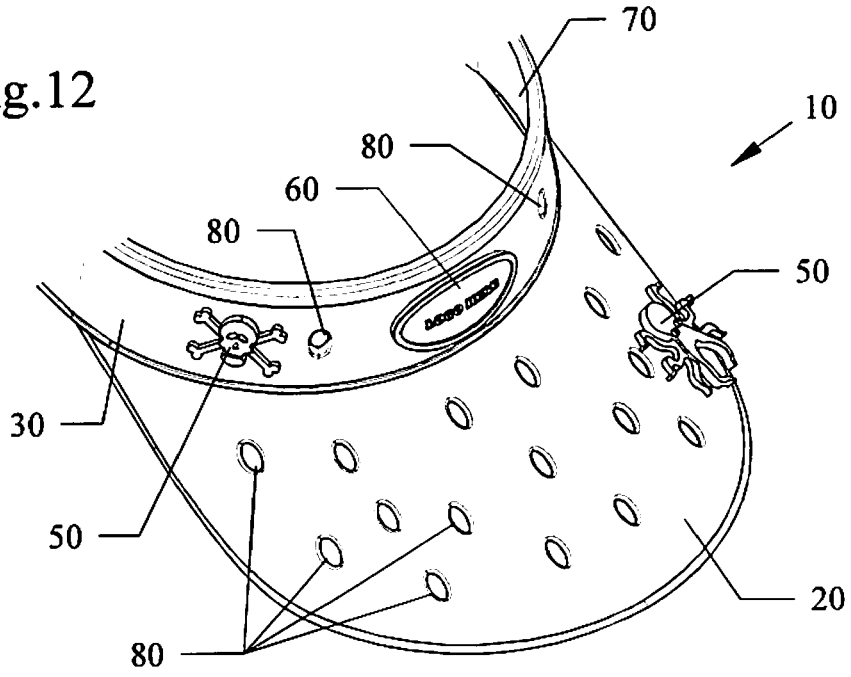
FIG. 12 is another top front perspective view of the visor assembly of FIG. 11 showing logo plate and charms installed.

FIG. 12 is another top front perspective view of the visor assembly 10 of FIG. 11 showing logo plate and charms installed.

Figure 13:
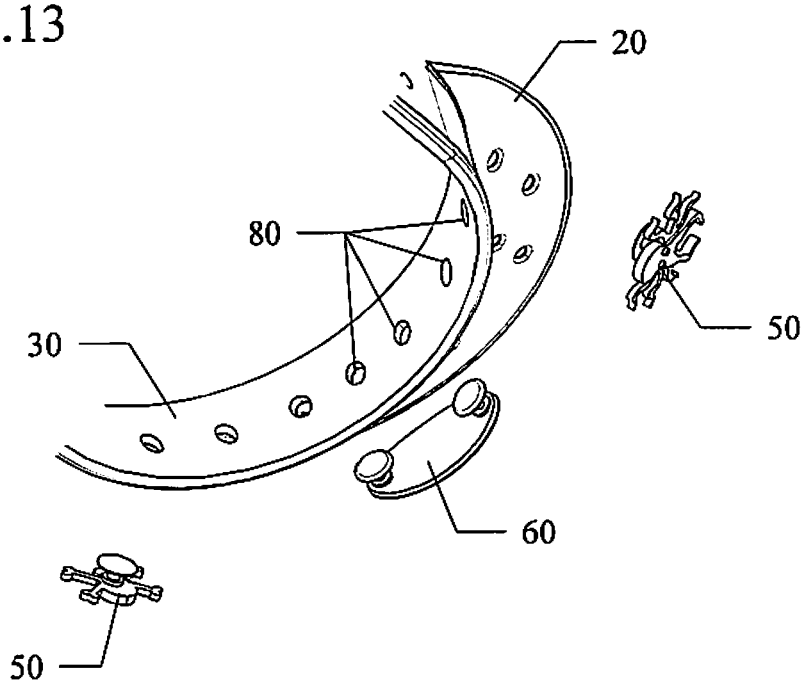
FIG. 13 is a bottom front inside perspective view of the visor assembly of FIG. 11 showing logo plate and charm ready to be installed.

FIG. 13 is a bottom front inside perspective view of the visor assembly 10 of FIG. 11 showing logo plate and charm ready to be installed.

Figure 14:
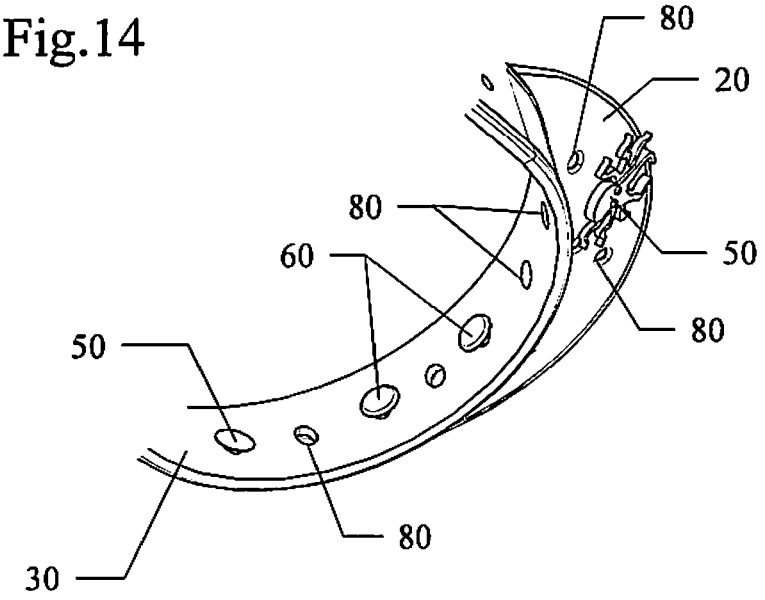
FIG. 14 is a bottom front inside perspective view of the visor assembly of FIG. 13 showing logo plate and charm installed.

FIG. 14 is a bottom front inside perspective view of the visor assembly 10 of FIG. 13 showing logo plate and charm installed.

Figure 15:
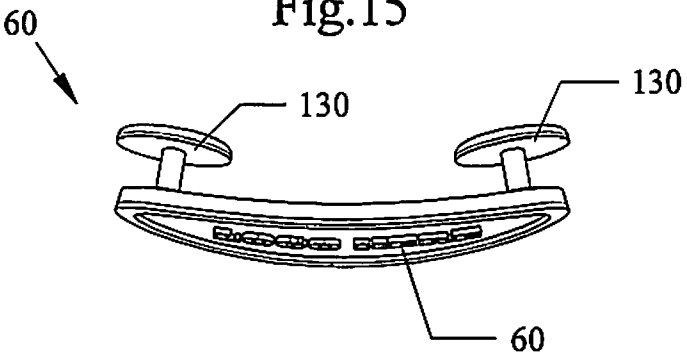
FIG. 15 is a top view of a logo plate for the visor assembly of the preceding figures.
Figure 16:
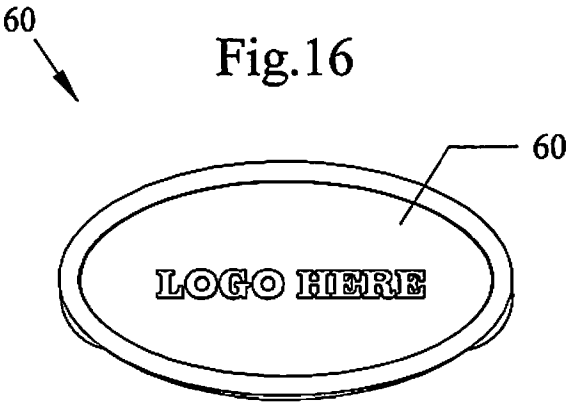
FIG. 16 is a front view of the logo plate of FIG. 15.
Figure 17:
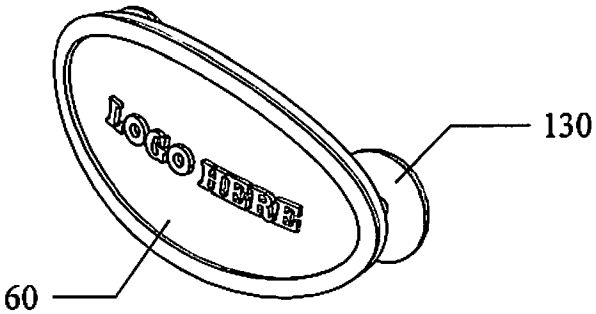
FIG. 17 is a front right perspective view of the logo plate of FIG. 15.
Figure 18:
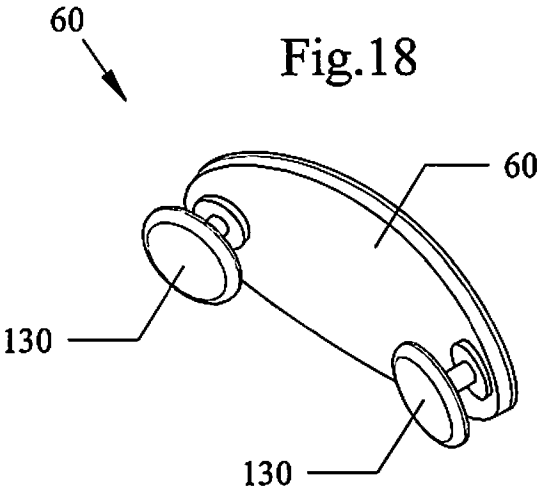
FIG. 18 is a rear right perspective view of the logo plate of FIG. 15.

FIG. 15 is a top view of a logo plate for the visor assembly 10 of the preceding figures. FIG. 16 is a front view of the logo plate of FIG. 15. FIG. 17 is a front right perspective view of the logo plate of FIG. 15. FIG. 18 is a rear right perspective view of the logo plate of FIG. 15. The logo plates can have indicia on a front surface portion, such as but not limited to advertisements, sports teams, names, pictures, and the like.

Figure 19:
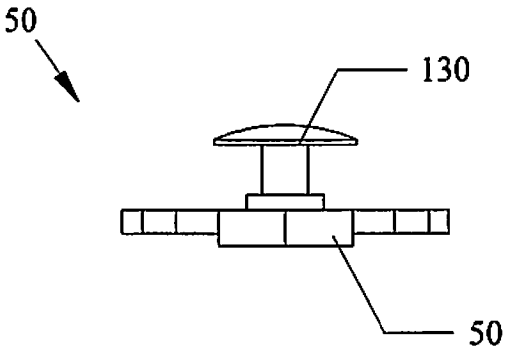
FIG. 19 is top view of a charm accessory for the visor assembly of the preceding figures.
Figure 20:
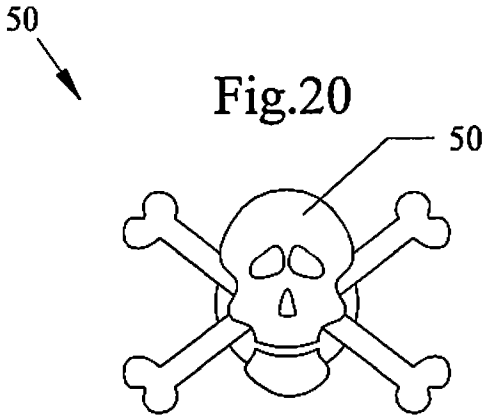
FIG. 20 is a front view of the charm of FIG. 19.
Figure 21:
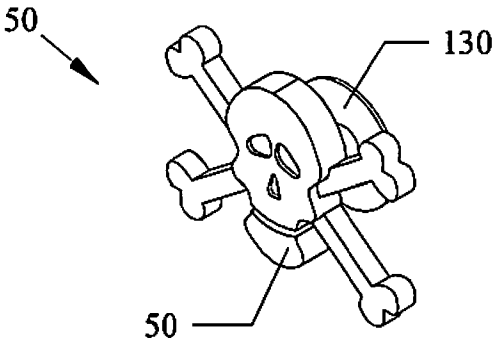
FIG. 21 is a front right perspective view of the charm of FIG. 19.
Figure 22:
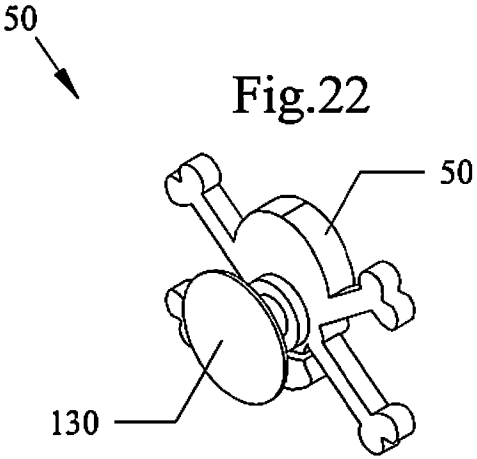
FIG. 22 is a rear right perspective view of the charm of FIG. 19.

FIG. 19 is top view of a charm accessory for the visor assembly 10 of the preceding figures. FIG. 20 is a front view of the charm of FIG. 19. FIG. 21 is a front right perspective view of the charm of FIG. 19. FIG. 22 is a rear right perspective view of the charm of FIG. 19. The charm accessory can be a decorative part, such as but not limited to a Jibitz™. The decorative pieces, can include various types of shapes, such as but not limited to animals, fish, birds, cartoon characters, flowers, trees, and the like.

Referring to FIGS. 1-22, the visor assembly can be comprised of two or three components. The main two components are the front part of the visor assembly which includes a visor portion 20 with front head band portion 30, that is separated from and attachable to a back band 40 type strap. A third component can be a sweatband 70 that can be attached into the inside wall of the head band portion 30.

The visor portion 20 with front band portion 30, and the back band (strap) 40 can be formed from or molded from a soft plastic, such as but not limited to EVA (ethylene vinyl acetate). The novel visor 10 can also be water proof, float in water, be anti-bacterial, have good clarity and gloss, barrier properties, low-temperature toughness, stress-crack resistance, hot-melt adhesive, and resistance to UV (ultra violet) radiation. EVA has little or no odor and is competitive with rubber and vinyl products in cost. The invention can be formed from other materials, similar to EVA, that also have similar properties.

The visor assembly 10 of the previous figures can have partial cutouts instead of completely through-hole cutouts 80. The partial cut-outs can have indentations through the visor/brim 20 and/or through the headband 30 that are not complete through-holes. These partial cut-outs can be molded to have narrow thicknesses than the rest of the visor/brim 20 and headband 30 material. As such, the user can use a puncture tool 140 as described in FIGS. 23-24 to complete the cut-out through the visor/brim 20 and/or headband 30 as desired. For example, a visor assembly 10 can have a mix of through-hole cutouts and partial cut-outs. Alternatively, the visor assembly can have all through-hole cutouts or all partial cut-outs.

Figure 23:
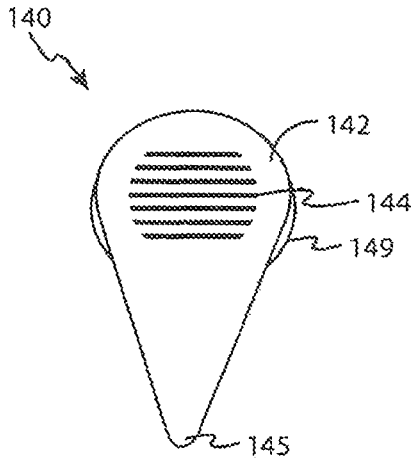
FIG. 23 is a front view of a puncture tool for use with visor assembly.
Figure 24:
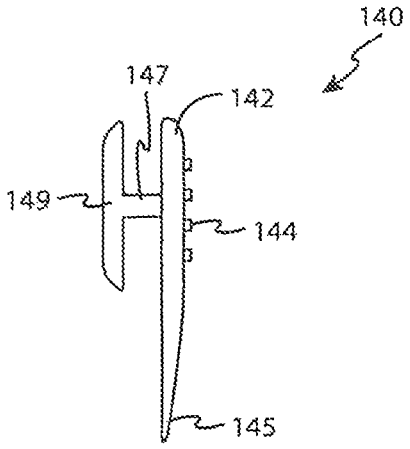
FIG. 24 is a side view of the puncture tool of FIG. 23.

FIG. 23 is a front view of a puncture tool 140 for use with visor assembly. FIG. 24 is a side view of the puncture tool 140 of FIG. 23. On the front 142 of the tool 140 can be a gripping surface that can have raised ribs or grooves thereon, and extending downward can be a narrow tip 145. The stud/rear wall 148 can be joined to the front wall by a stem portion 147. In operation, the user can grip the tool 140 by pinching the front wall 142 and rear wall 148 between two fingers, and push the narrow tip 145 into a partial cut-out opening 80 as desired to mount charm(s) 50, logo plate(s) 60 thereon. The tool 140 can also be stored on the visor assembly 1 by pushing the stud/rear wall 148 into a throughhole cut-out 80 on the visor assembly.

The invention can be distributed and/or sold in a package or kit form, having visor assembly 1, along with a plurality of logo plates 60 and decorative (charm) parts 50 and puncture tool 140, and sunglass/eyeglass adapter 170.

Although, the cut-out slots (sockets) 80, 100 for the labels 60 and charms 50 are shown to be circular, the sockets can have other geometrical shapes, such as but not limited to triangular, rectangular, hexagon, and the like. Still furthermore, the sockets can be customized into other desirable shapes such as but not limited to character outline shapes, such as MICKEY MOUSE®, animals, mammals, birds, fish, and any other desirable outline shape, and the like.

Figure 25:
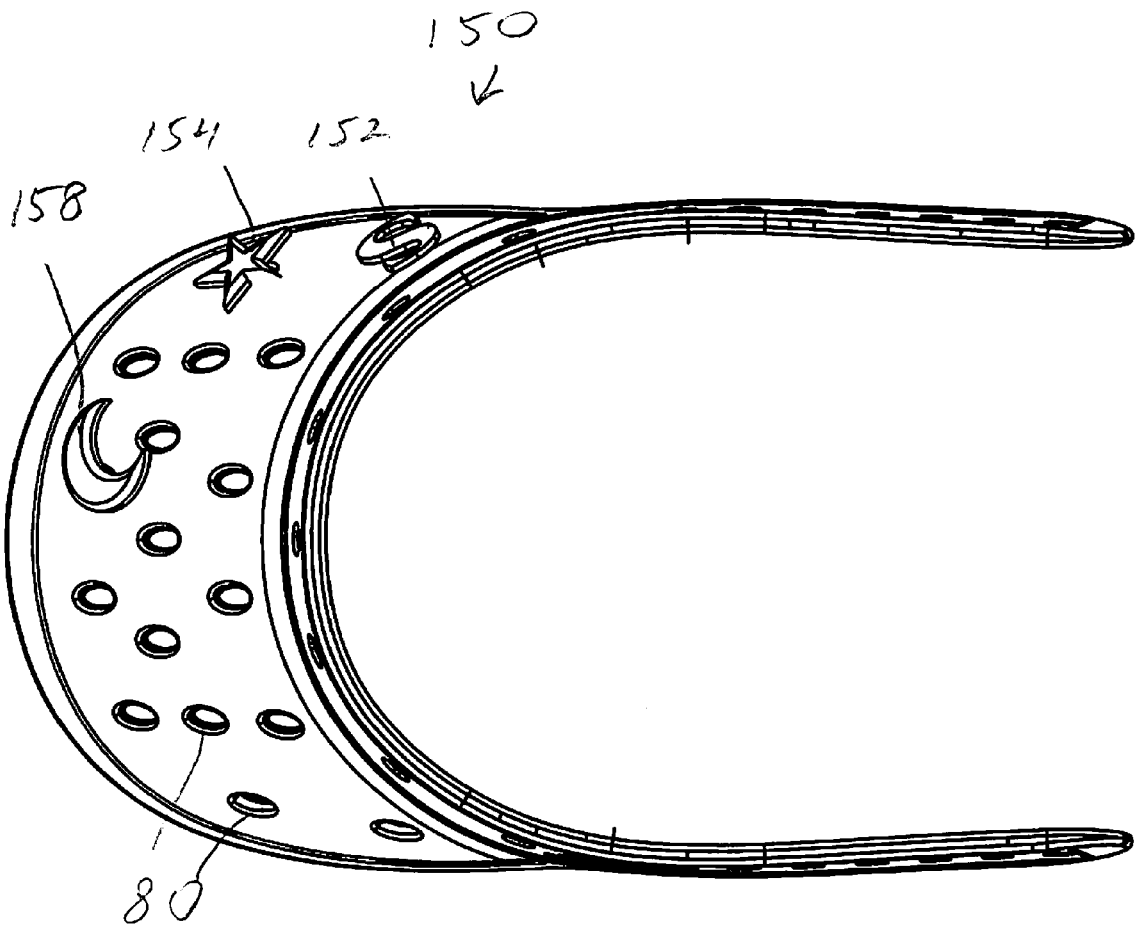
FIG. 25 is a top view of another visor assembly.
Figure 26:
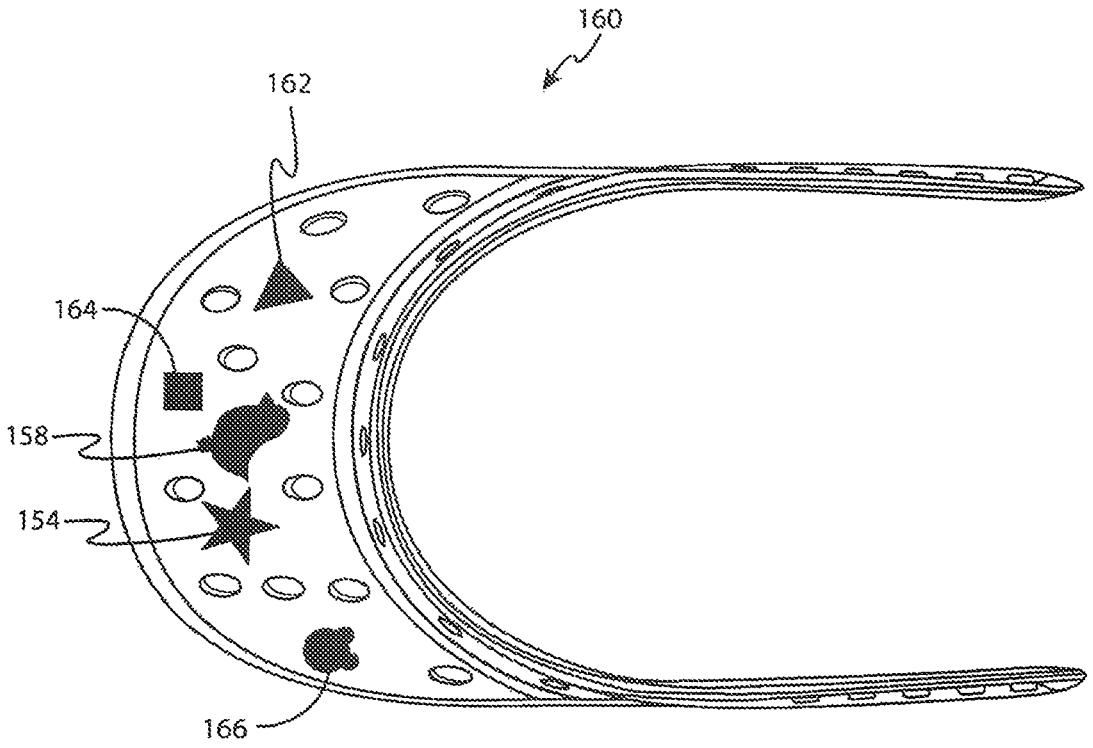
FIG. 26 is a top view of still another visor assembly.

FIG. 25 is a top view of another visor assembly 150. FIG. 26 is a top view of still another visor assembly 160. Here, different shapes, such as letter shaped cutout 152, star shaped cutout 154, half moon shaped cutout 158, triangle shaped cutout 162, rectangular/square shaped cutout 164, and other shapes 166, such as cartoon character shaped cutout 166 can be formed into the visor assembly 150, 160.

Figure 27:
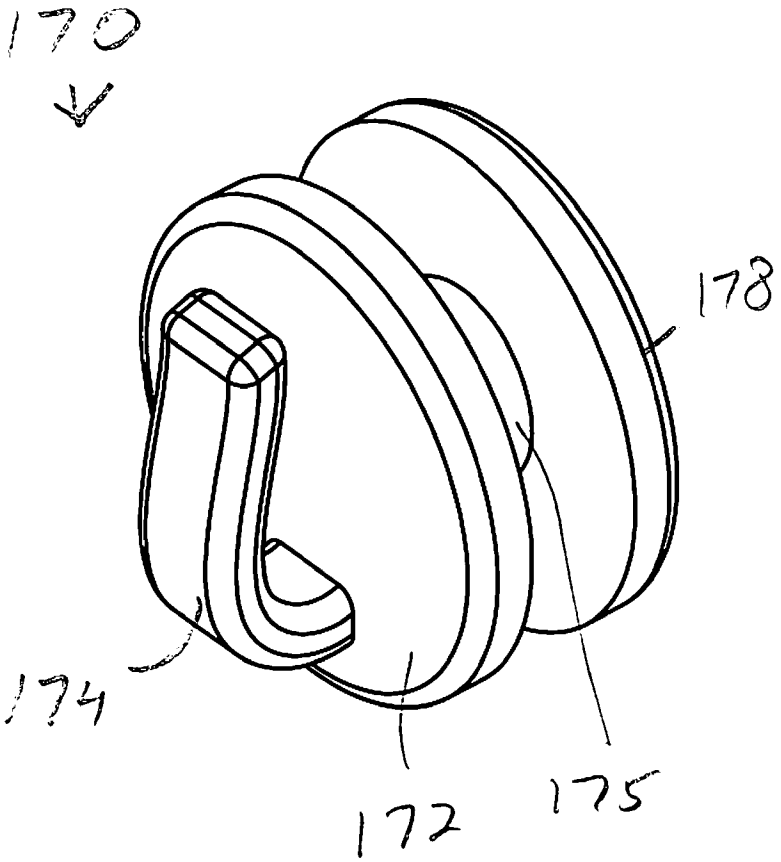
FIG. 27 is a perspective view of an adapter for mounting sunglasses/eyeglasses to the visor assembly.
Figure 29:
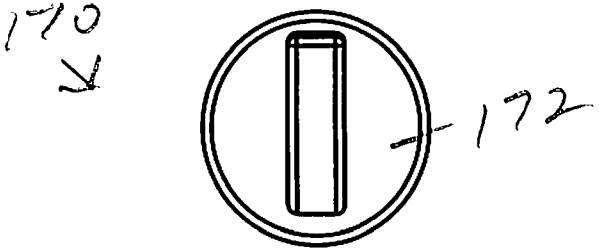
FIG. 29 is a front view of the adapter of FIG. 27.
Figure 28:
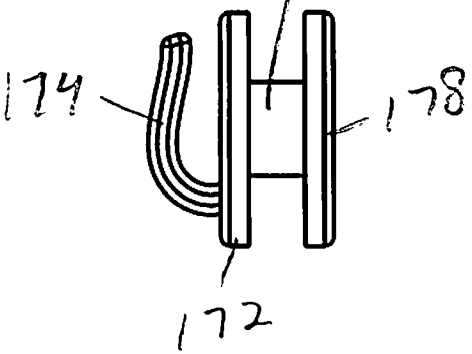
FIG. 28 is a side view of the adapter of FIG. 27.
Figure 30:
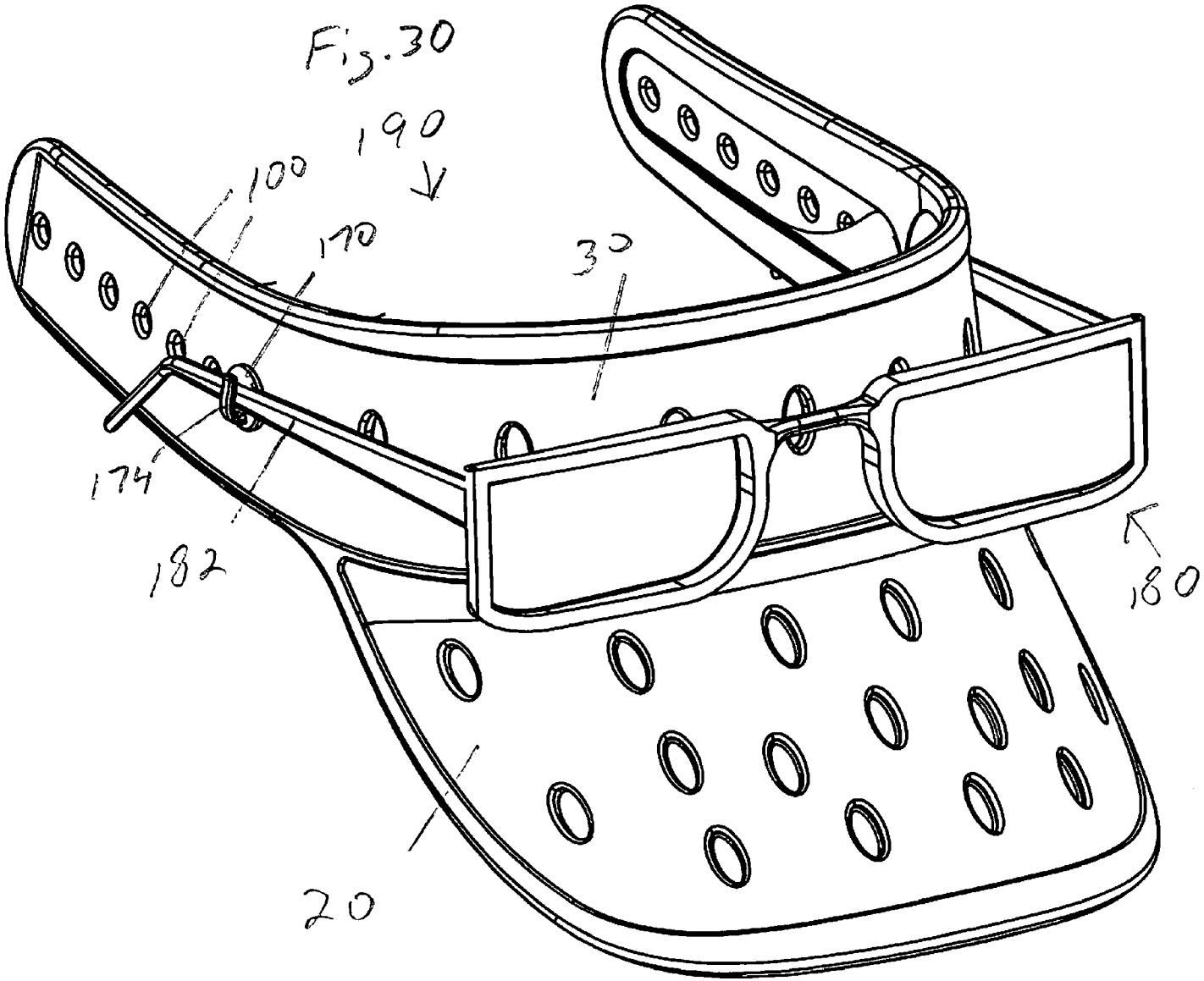
FIG. 30 is a front perspective view of a visor assembly with adapter of FIG. 27 and mounted sunglasses/eyeglasses.
Figure 31:
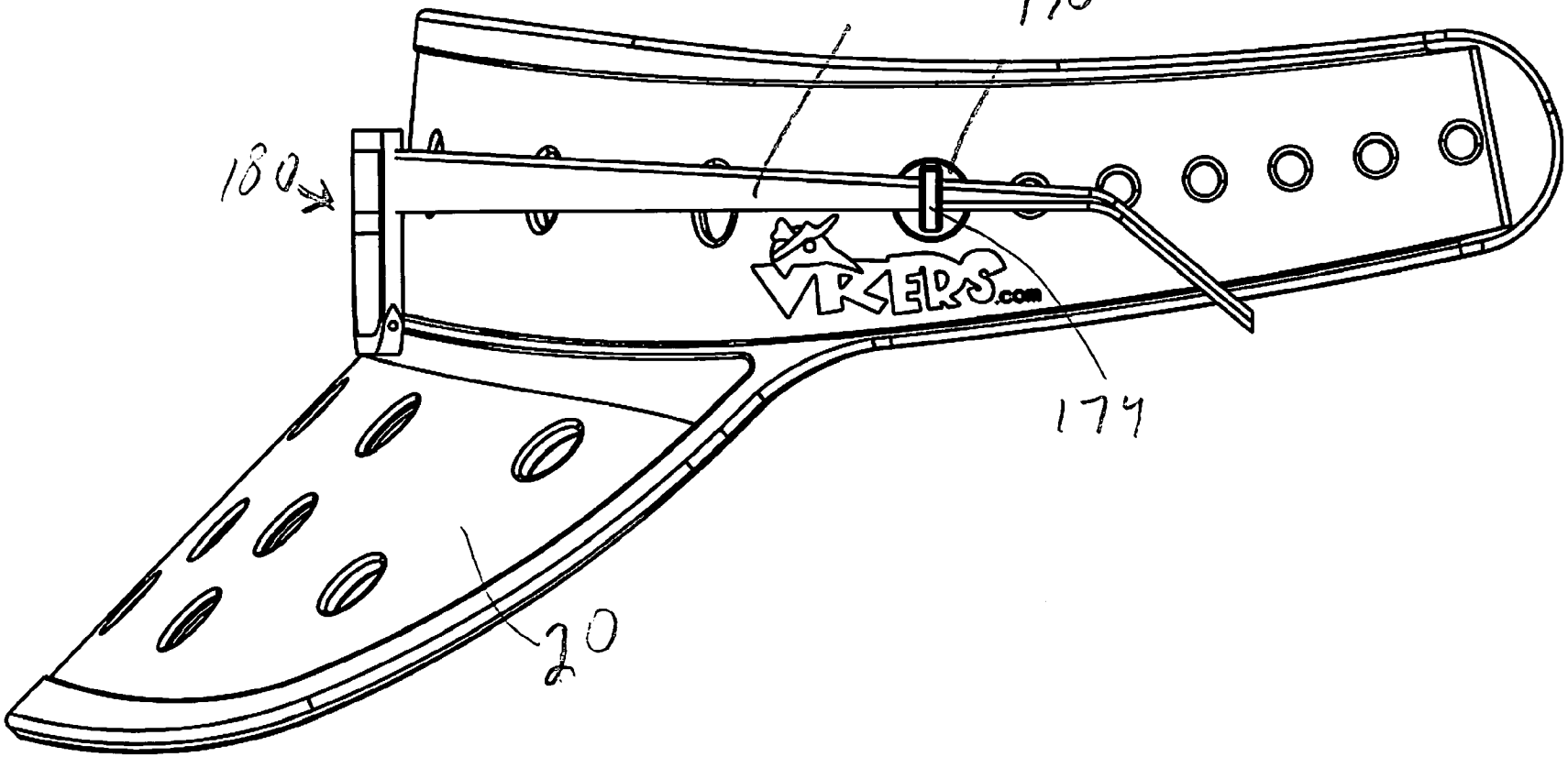
FIG. 31 is a side view of the visor assembly, adapter and mounted sunglasses of FIG. 30.
Figure 32:
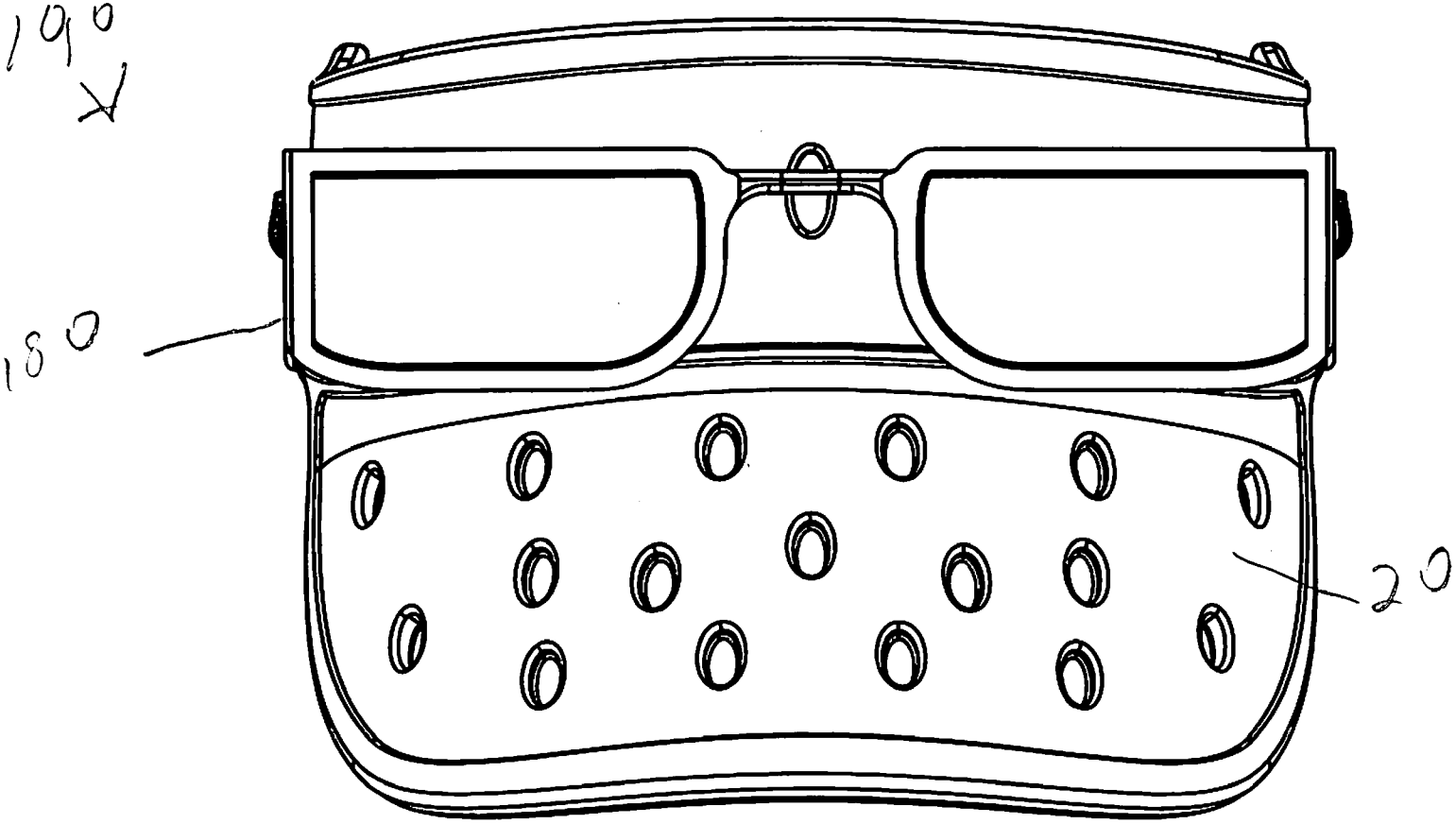
FIG. 32 is a front view of the visor assembly, adapter and mounted sunglasses of FIG. 30.

FIG. 27 is a perspective view of an adapter 170 for mounting sunglasses/eyeglasses to the visor assembly 190 (shown in FIGS. 30-32. FIG. 28 is a side view of the adapter 170 of FIG. 27. FIG. 29 is a front view of the adapter 170 of FIG. 27. The adapter 170 can include a front wall 172 having a curved hook 174 fixed thereon, with a stem 175 to attach to a stud/rear wall 178.

FIG. 30 is a front perspective view of a visor assembly 190 with adapter of FIG. 27 and mounted sunglasses/eyeglasses 180. FIG. 31 is a side view of the visor assembly 190, adapter 170 and mounted sunglasses 180 of FIG. 30. FIG. 32 is a front view of the visor assembly 190, adapter 170 and mounted sunglasses 180 of FIG. 30. The user can push the stud/rear wall 178 of the adapter 170 through headband adjustment holes 100 on both sides of the visor assembly 190 with the free end of the hook 174 angled upward. Next, the arms 182 of the eyeglasses/sunglasses 180 can be positioned into the hook portions 174, with the glass portions of the eyeglasses/sunglasses 180 positioned on the visor/brim 20. The curved hooks 174 can be angled so that the arms 182 of the eyeglasses/sunglasses 180 are tightly held in place. The user can safely store their eyeglasses/sunglasses 180 on the visor assembly 190. And when the eyeglasses/sunglasses 180 are needed, the user, can easily remove the eyeglasses/sunglasses 180 from the adapter 170 to wear them when needed.

While the invention shows plug on labels and charms, the invention can be used with other accessories. For example, a scalp cover can attach to the top of the visor assembly and have plug in base members that allow for the cover to protect the scalp of the wearer. Furthermore, a neck shade attachment formed from similar material or formed from cloth or fabric, can attach by plugable members to the rear of the band strap. Still furthermore, other accessories, such as but not limited to sunglass shades, and the like, can also be plugable onto the visor assembly.

Second Embodiment

Figure 33:
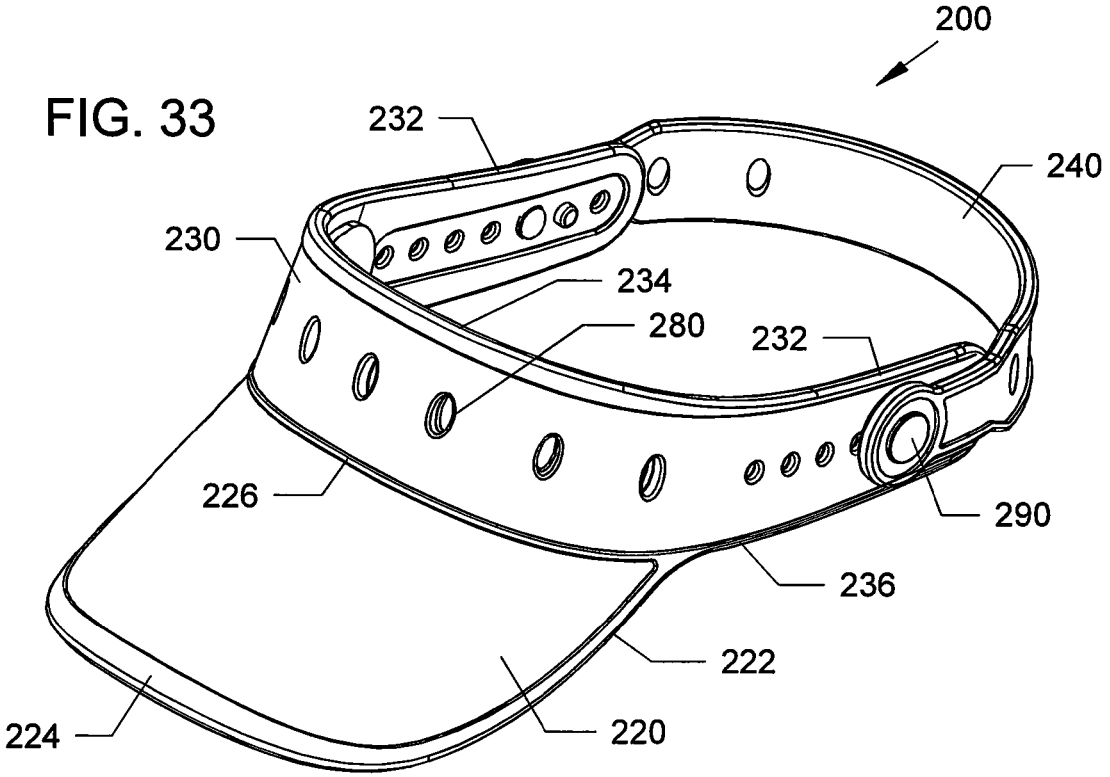
FIG. 33 is an upper front right perspective view of another embodiment of the novel improved head visor with plug-in accessory sockets in the band.
Figure 34:
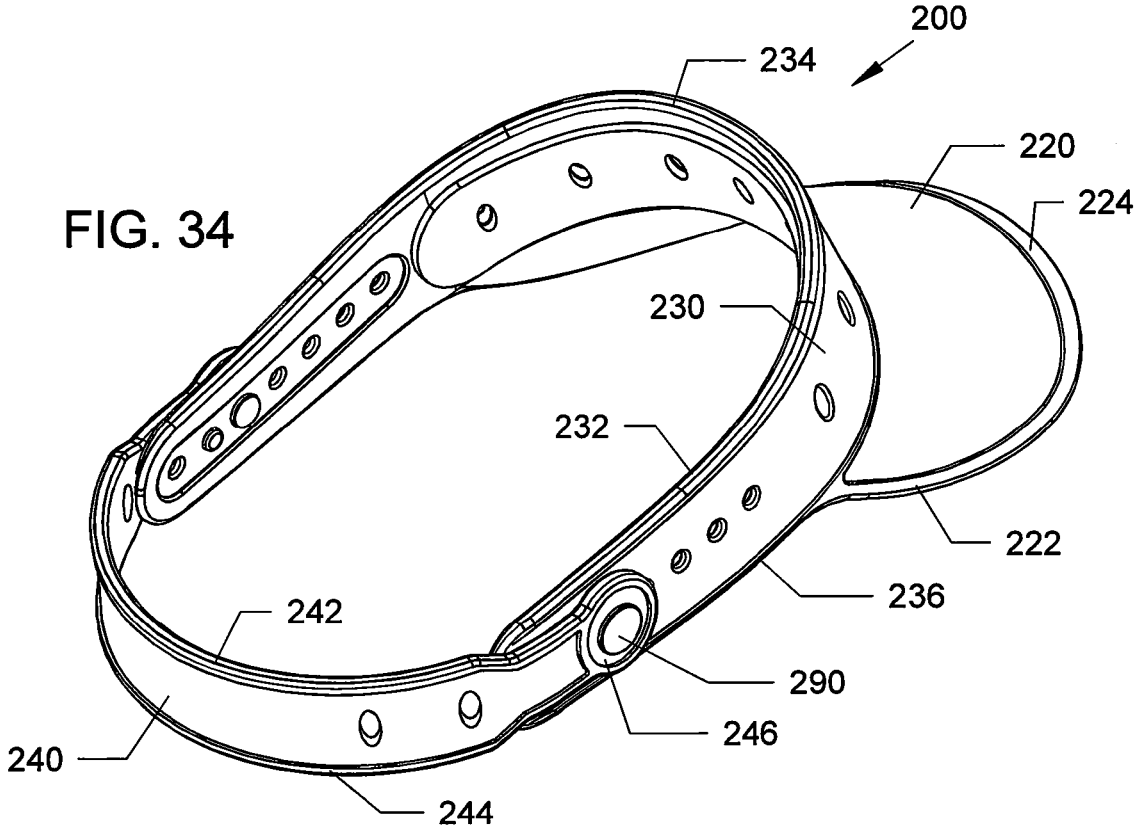
FIG. 34 is an upper right rear perspective view of the head visor of FIG. 33.
Figure 35:
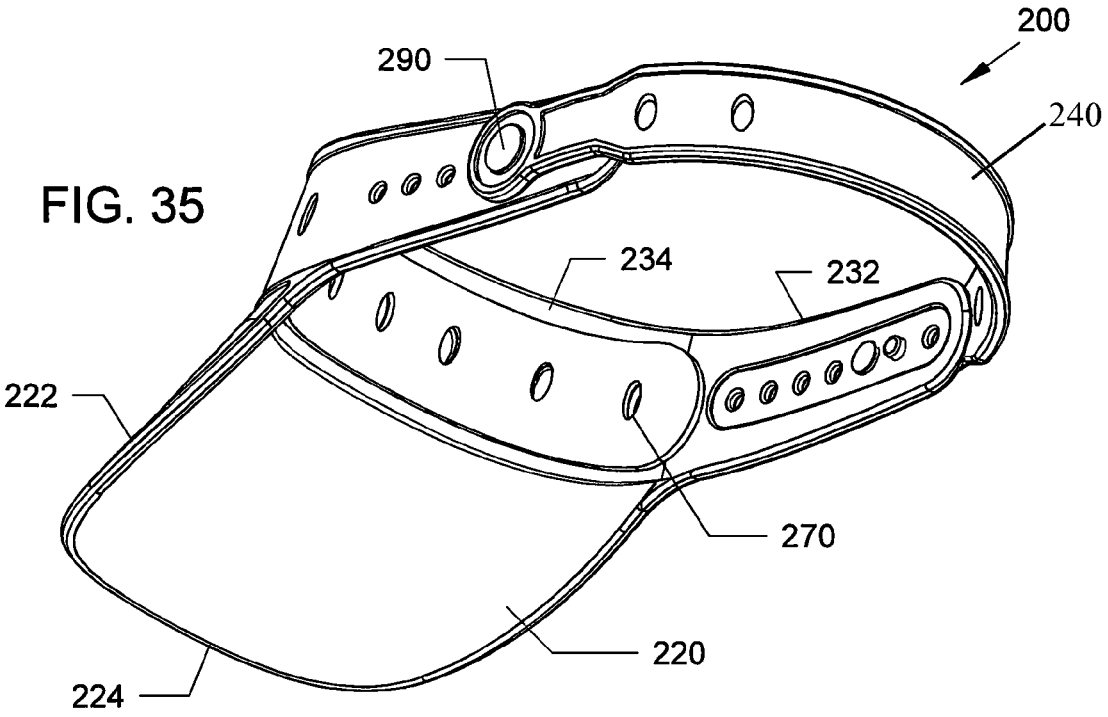
FIG. 35 is a lower rear perspective view of the head visor of FIG. 33.
Figure 36:
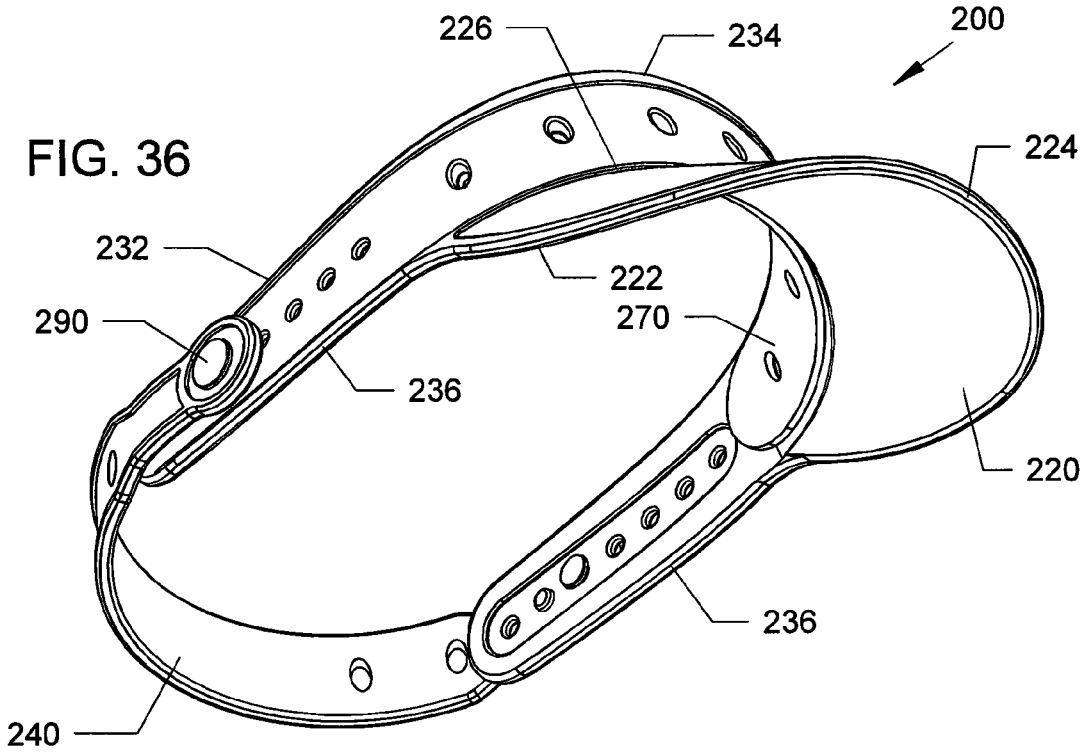
FIG. 36 is a lower front perspective view of the head visor of FIG. 33.
Figure 37:
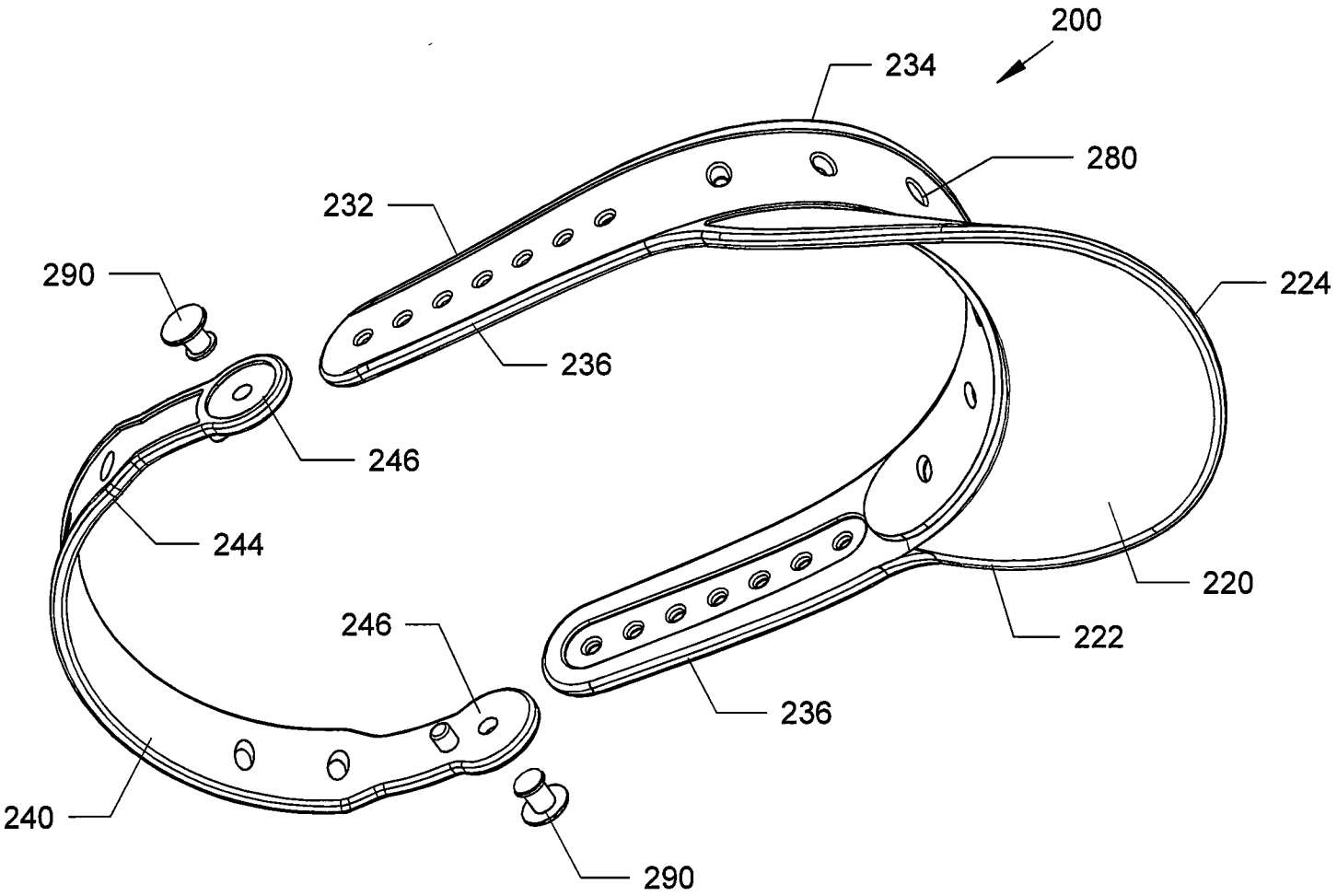
FIG. 37 is a lower perspective exploded view of the head visor of FIG. 33.
Figure 38:
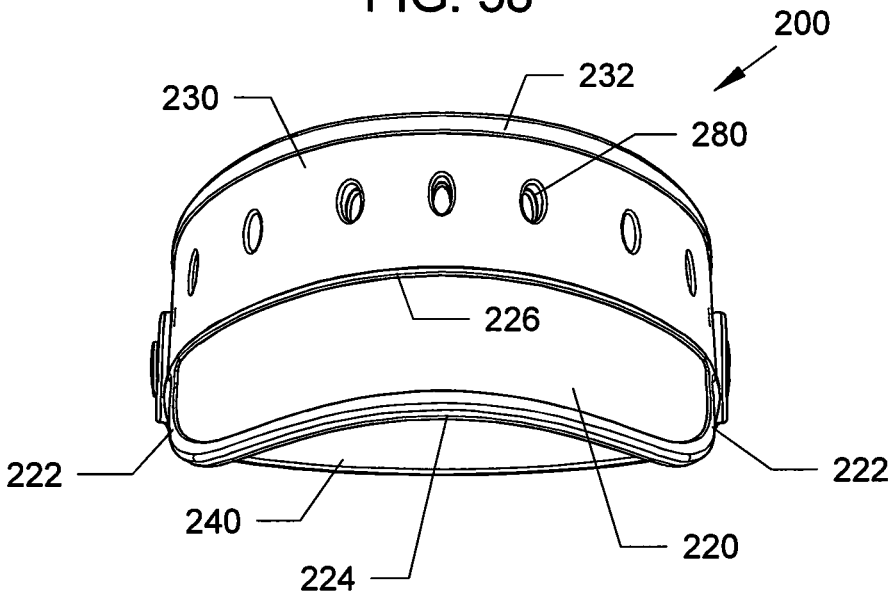
FIG. 38 is a front view of the head visor of FIG. 33.
Figure 39:
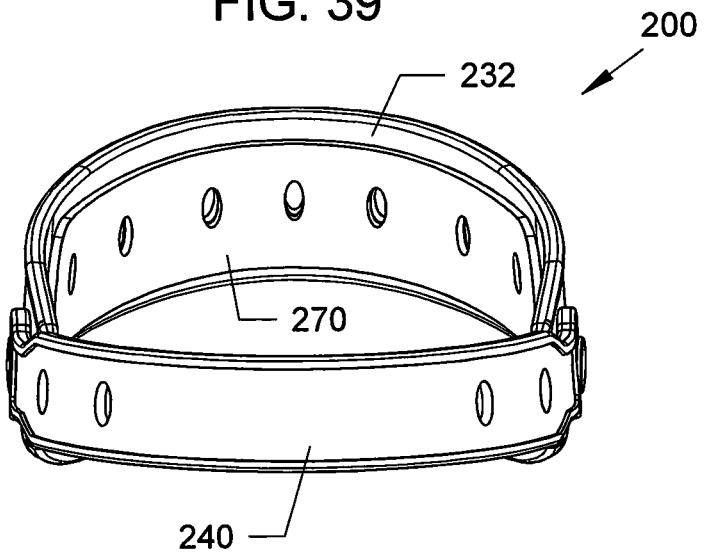
FIG. 39 is a rear view of the head visor of FIG. 33.
Figure 40:
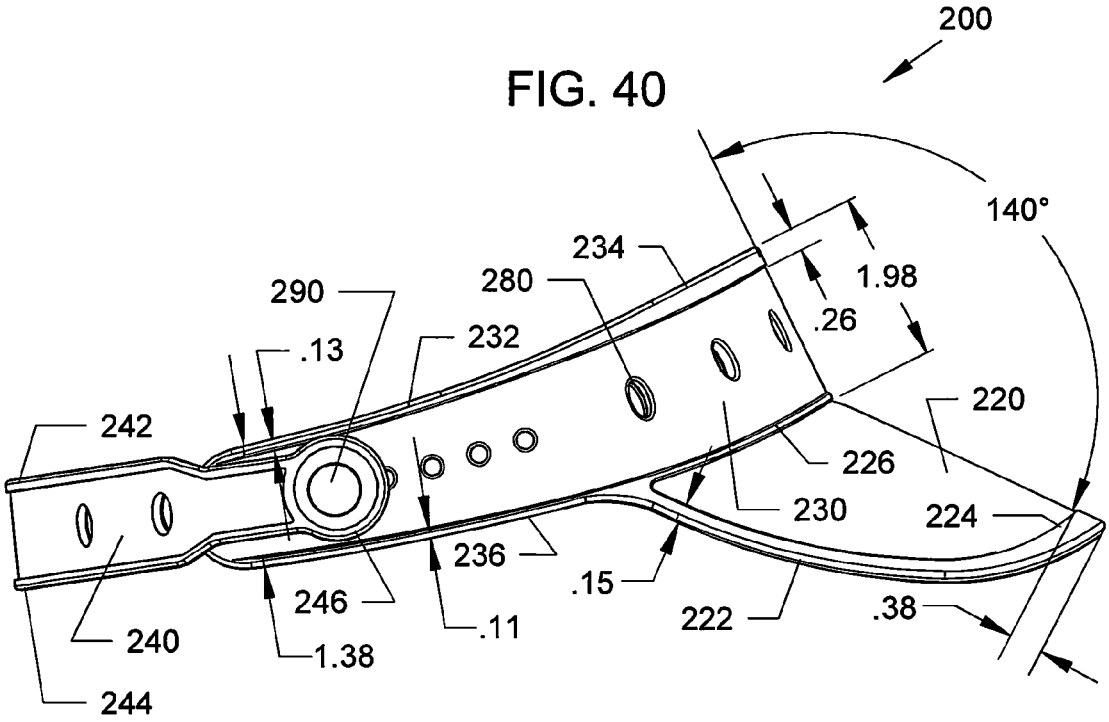
FIG. 40 is a right side view of the head visor of FIG. 33.
Figure 41:
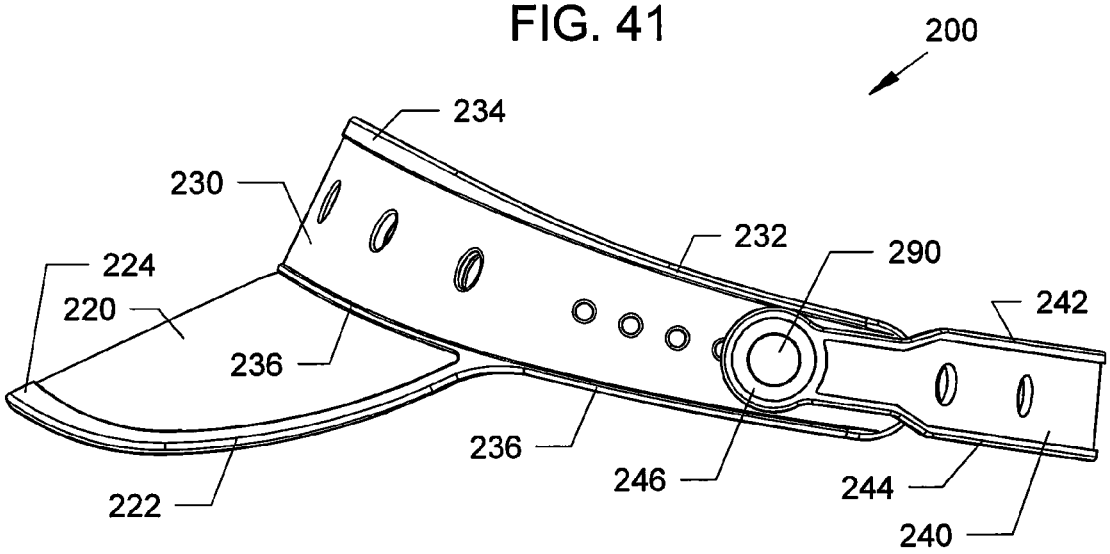
FIG. 41 is a left side view of the head visor of FIG. 33.
Figure 42:
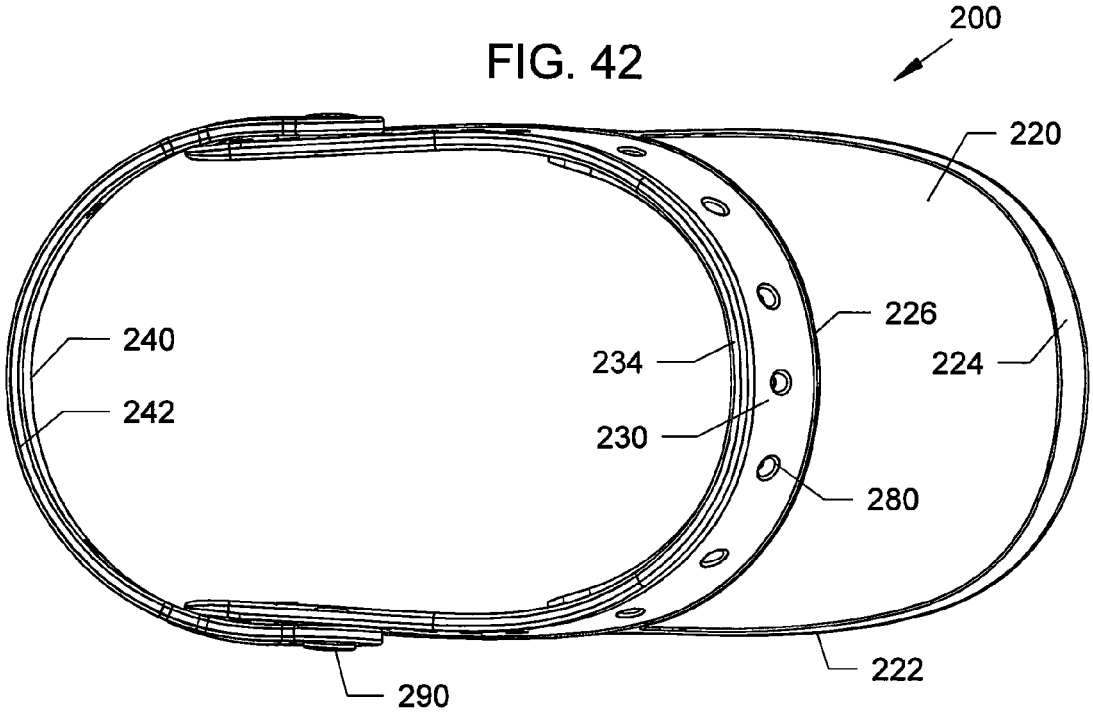
FIG. 42 is a top view of the head visor of FIG. 33.
Figure 43:
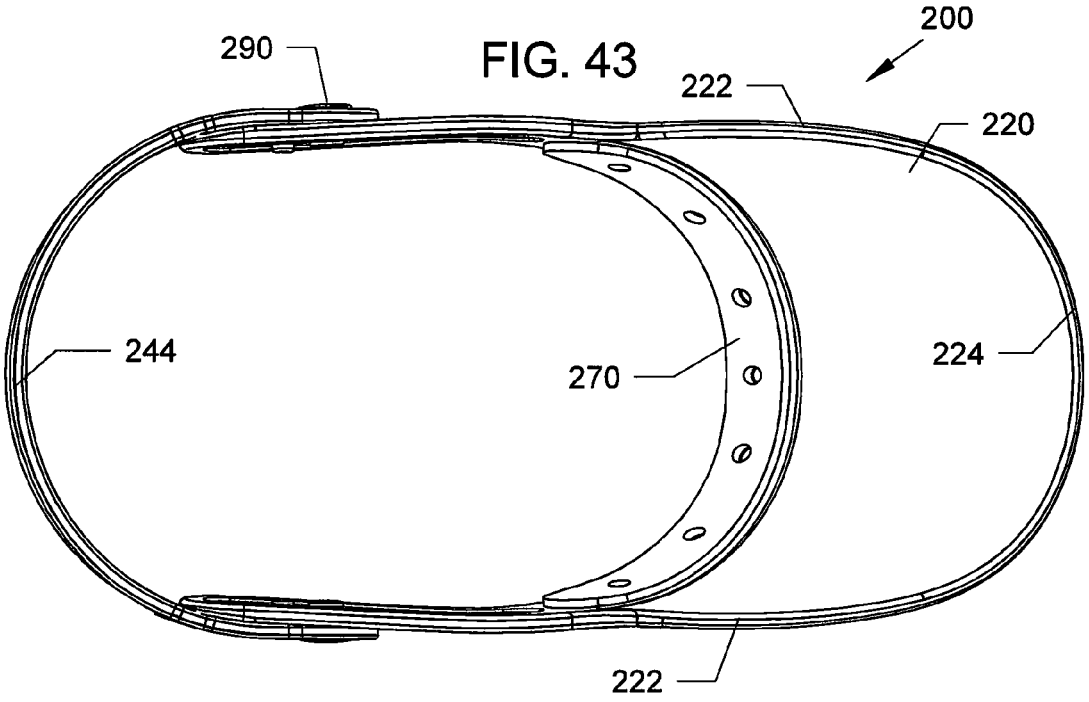
FIG. 43 is a bottom view of the head visor of FIG. 33.

FIG. 33 is an upper front right perspective view of another embodiment of the novel improved head visor 200 with plug-in accessory sockets 280 in the band. FIG. 34 is an upper right rear perspective view of the head visor 200 of FIG. 33. FIG. 35 is a lower rear perspective view of the head visor 200 of FIG. 33. FIG. 36 is a lower front perspective view of the head visor 200 of FIG. 33. FIG. 37 is a lower perspective exploded view of the head visor 200 of FIG. 33. FIG. 38 is a front view of the head visor 200 of FIG. 33. FIG. 39 is a rear view of the head visor 200 of FIG. 33. FIG. 40 is a right side view of the head visor 200 of FIG. 33. FIG. 41 is a left side view of the head visor 200 of FIG. 33. FIG. 42 is a top view of the head visor 200 of FIG. 33. FIG. 43 is a bottom view of the head visor 200 of FIG. 33.

Referring to FIGS. 33-43, the head visor 200 can be formed from the same material as described in the previous embodiment and can include a one piece front head band 230 and brim 220, and separate back (rear) band that attached to one another as described in the previous embodiment.

The head visor 200 can include a front head band that can have an overall height of approximately 1.98 inches, and the rearwardly extending sides can taper downward to a height of approximately 1.38 of an inch. The front end (front rim 224) can angle downwardly from the top (upper rim 234) of the headband 230 at an angle of approximately 140 degrees.

The brim 220 can include a raised rim 222/224 about an outer perimeter edge of the brim 220, the raised rim having a thickness and a width, along with a rear raised rim 226 between the brim 220 and the front head band 230. The thickness of the raised rim can be approximately 3/16 inch thick. The narrow width rim 222 about side edges of the brim 220 can expand into a wider rim 224 about a front portion of the brim 220. The narrow side rim 222 can have a width of approximately 0.11 inches and the wider front rim 224 a width of approximately 0.38 inches.

The front headband 230 can include an upper raised rim 234 and a lower raised rim (rear raised rim 226) parallel to the upper raised rim 234. The front head band 230 can include rearwardly extending sides each having an upper side rim 232 and lower side rim 236. The upper raised rims 232, 324 and lower raised rim 236, 226 can each include a thickness of approximately ¼ inch.

The back (rear) band 240 can include an upper raised rim 242 and a lower raised rim 244 parallel to the upper raised rim 242, each rim 242, 244, having thickness and a width. The thickness of each raised rim 242, 244 can be approximately 3/16 of an inch. The height of each raised rim 242, 244 can be approximately ⅛ of an inch.

Each end of the rear headband 240 includes a generally circular shape 246 with a circular raised rim, having a similar thickness and height to the raised rims 242, 244. The circular rear end 246 can include a diameter of approximately 1 3/16 of an inch with the rivets 290 for attaching the rear band 240 to the rearwardly extending sides of the front headband 230. Each of the rivets can have a rounded head portion that can have a diameter of approximately 9/16 of an inch.

The term "approximately" can include +/− ten percent of the number value that follows the term "approximately."

Referring to FIGS. 33-43, the front facing surface of the front headband 230 between the upper raised rim 234 and lower raised rim 226 (rear edge of brim) can include at least one socket 280 (opening) therethrough for allowing accessories, such as those previously described to be attached thereto. The upper exposed surface of the brim 220 between the outer raised rims 222/224 can include a solid smooth surface that does not include sockets (openings) in the surface.

Third Embodiment

Figure 44:
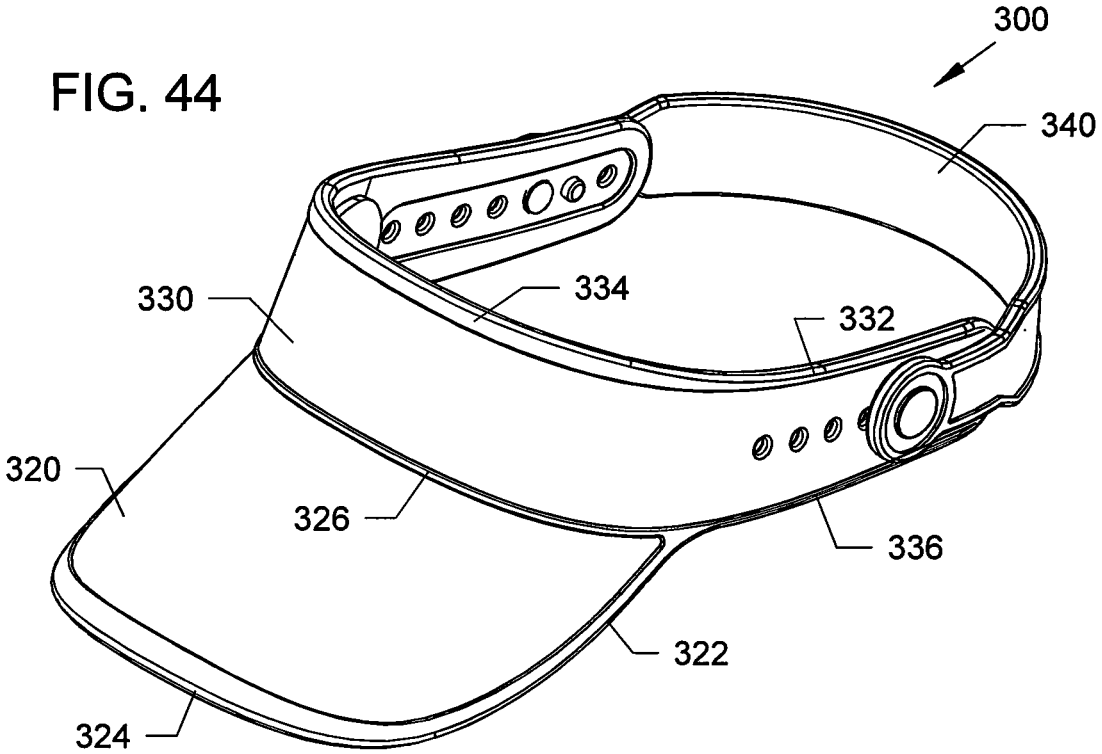
FIG. 44 is an upper front right perspective view of another embodiment of the novel improved head visor with brim and head band.
Figure 45:
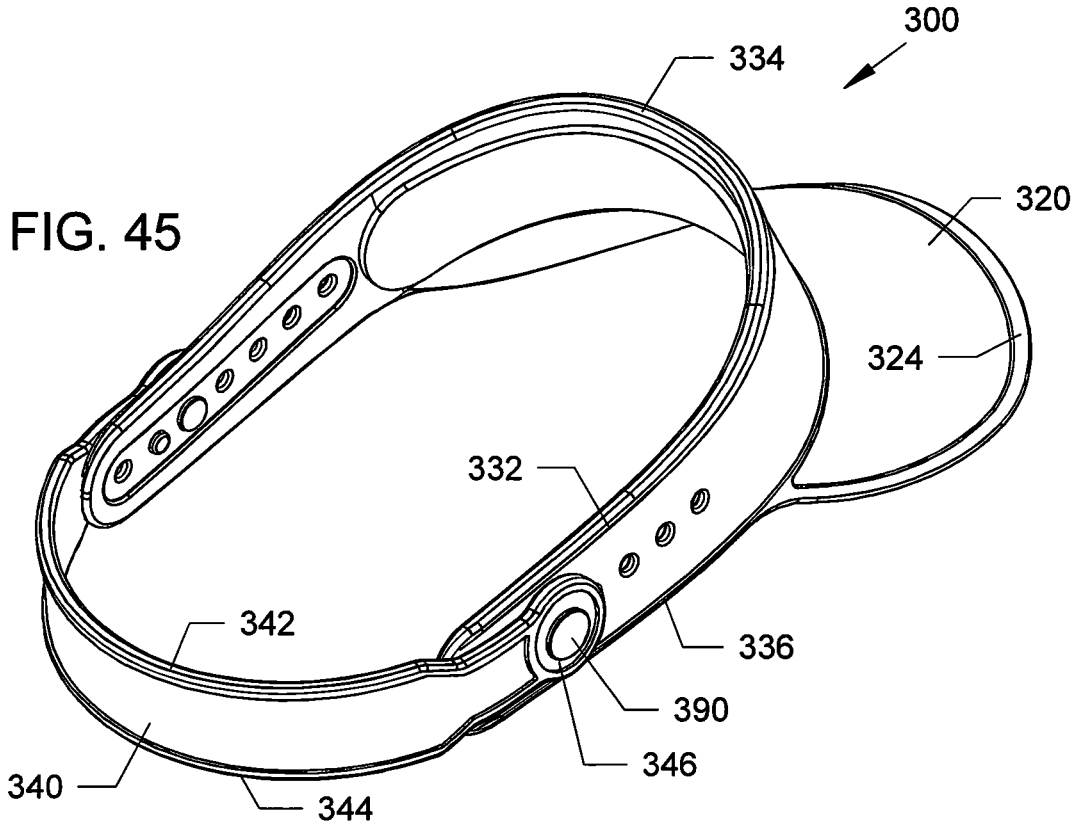
FIG. 45 is an upper right perspective view of the head visor of FIG. 44.
Figure 46:
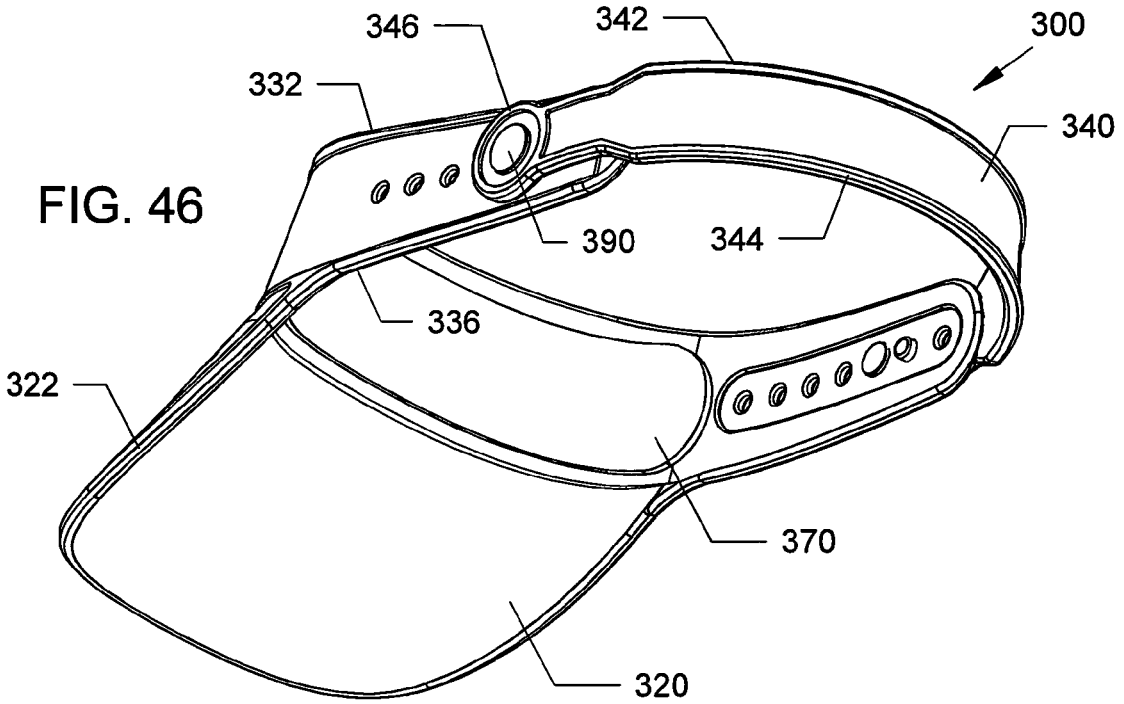
FIG. 46 a lower rear perspective view of the head visor of FIG. 44.
Figure 47:
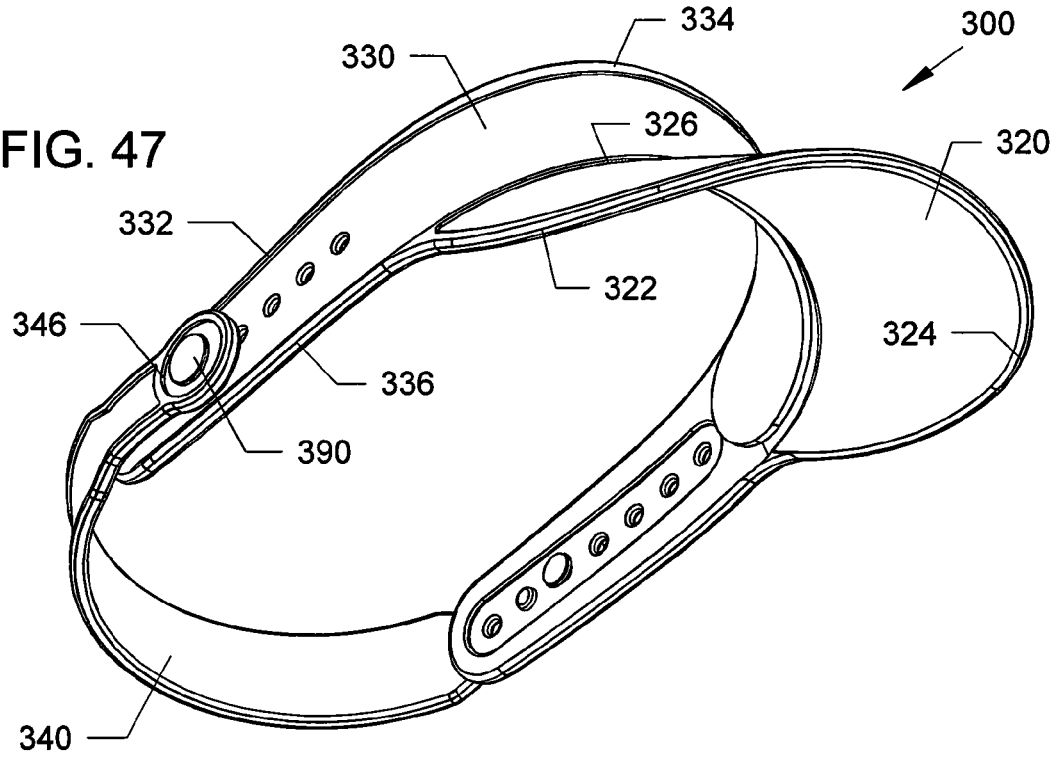
FIG. 47 a lower front perspective view of the head visor of FIG. 44.
Figure 48:
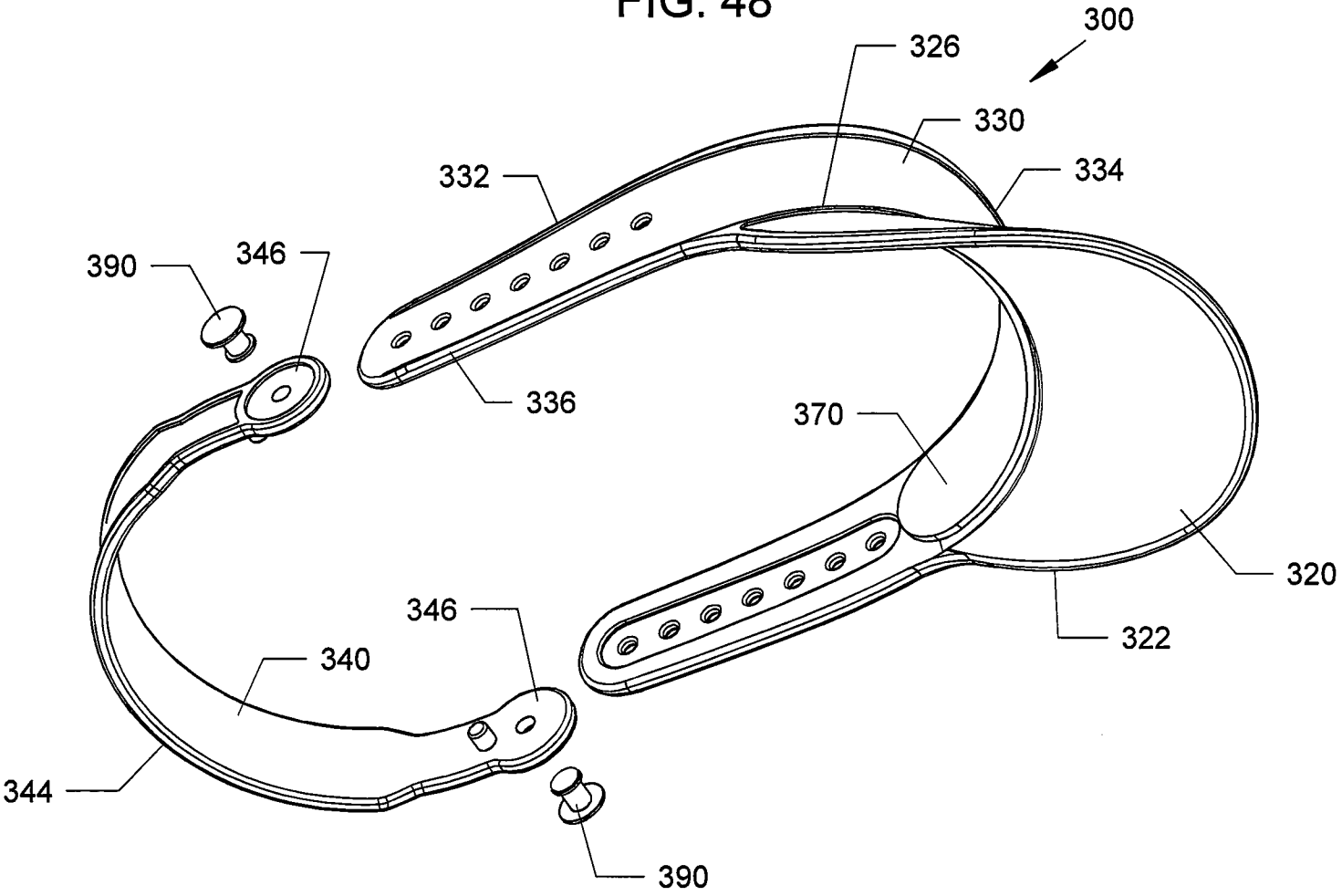
FIG. 48 is a lower perspective exploded view of the head visor of FIG. 44.
Figure 49:
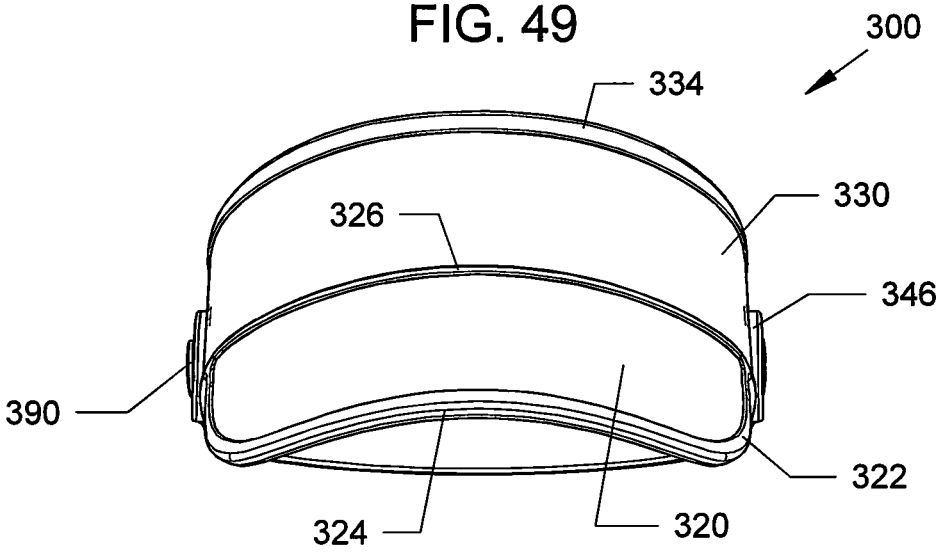
FIG. 49 is a front view of the head visor of FIG. 44.
Figure 50:
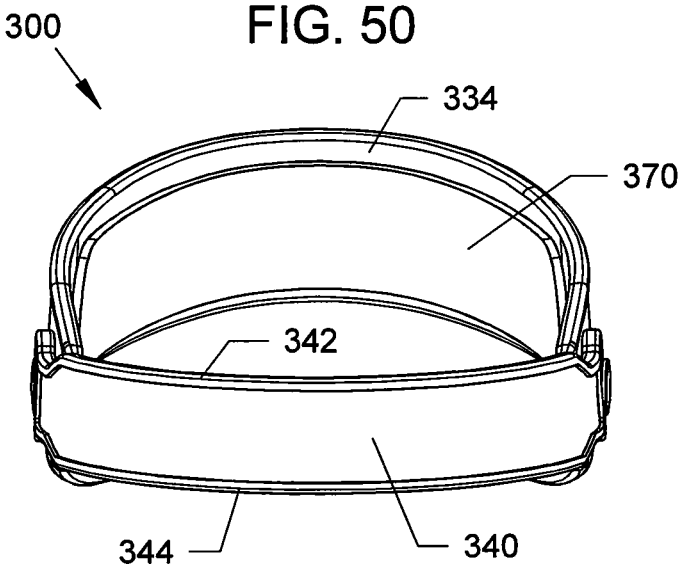
FIG. 50 is a rear view of the head visor of FIG. 44.
Figure 51:
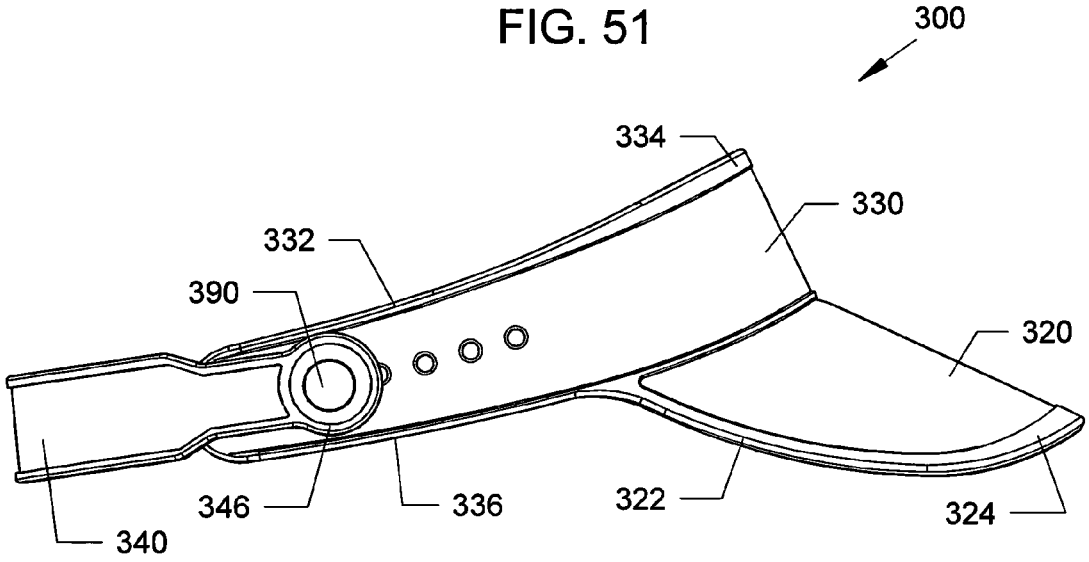
FIG. 51 is a right side view of the head visor of FIG. 44.
Figure 52:
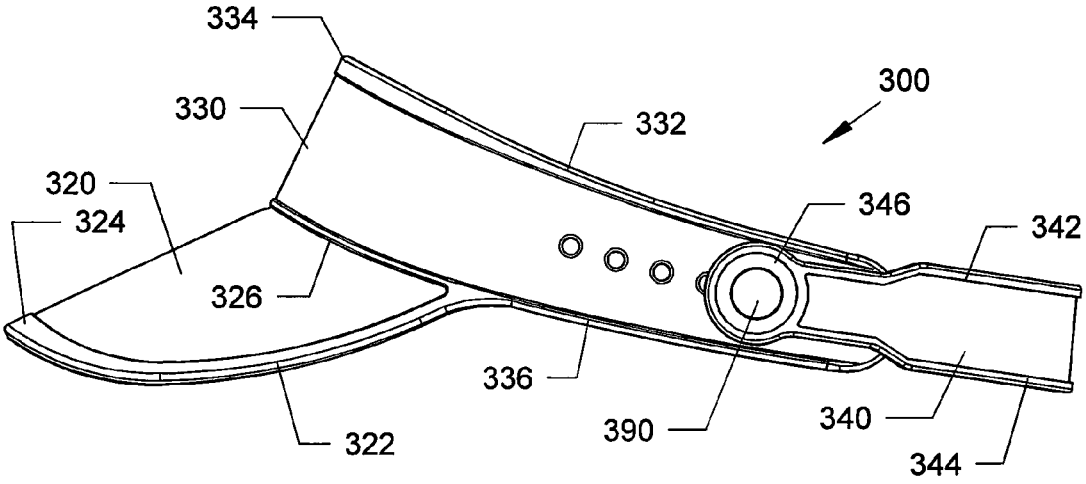
FIG. 52 is a left side view of the head visor of FIG. 44.
Figure 53:
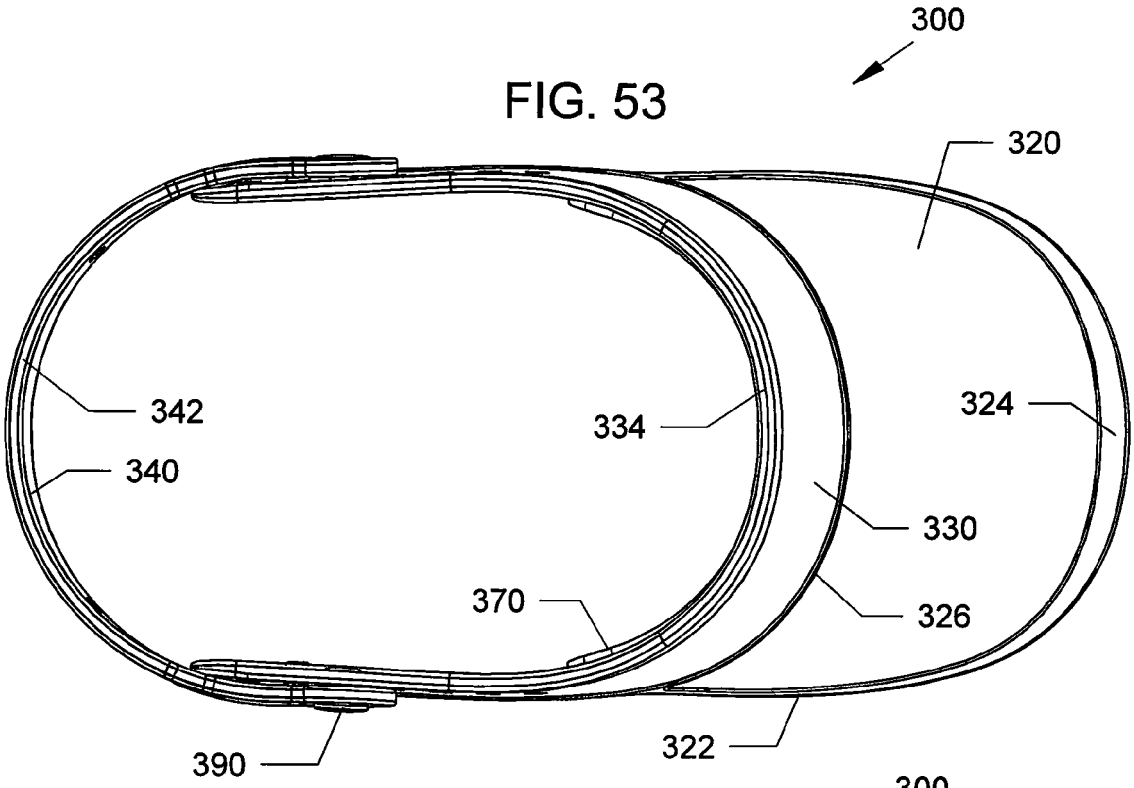
FIG. 53 is a top view of the head visor of FIG. 44.
Figure 54:
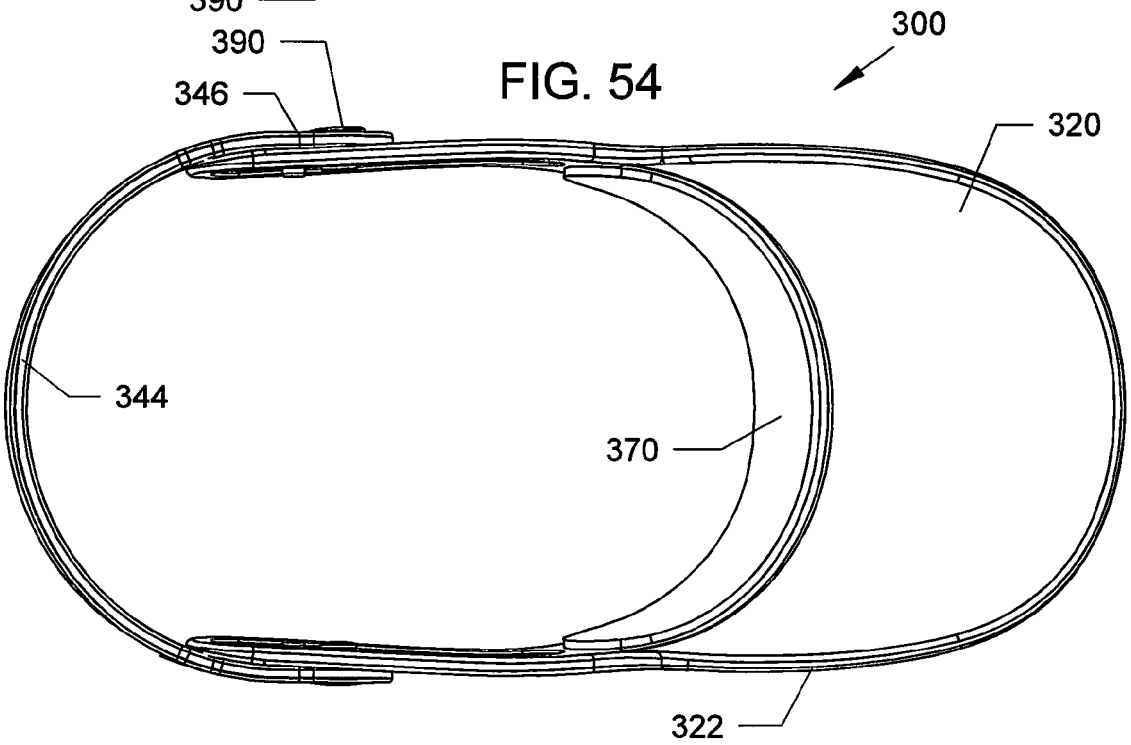
FIG. 54 is a bottom view of the head visor of FIG. 44.

FIG. 44 is an upper front right perspective view of another embodiment of the novel improved head visor 300 with brim 320 and head band 330 with no sockets (openings) in the front head band 330 and no sockets (openings) across the outer surface of the brim 320. FIG. 45 is an upper right perspective view of the head visor 300 of FIG. 44. FIG. 46 a lower rear perspective view of the head visor 300 of FIG. 44. FIG. 47 a lower front perspective view of the head visor 300 of FIG. 44. FIG. 48 is a lower perspective exploded view of the head visor 300 of FIG. 44. FIG. 49 is a front view of the head visor 300 of FIG. 44. FIG. 50 is a rear view of the head visor 300 of FIG. 44. FIG. 51 is a right side view of the head visor 300 of FIG. 44. FIG. 52 is a left side view of the head visor 300 of FIG. 44. FIG. 53 is a top view of the head visor 300 of FIG. 44. FIG. 54 is a bottom view of the head visor 300 of FIG. 44.

Referring to FIGS. 44-53, the labeled components 320, 322, 324, 326, 330, 332, 334, 336, 340, 342, 344, 346, 370, and 390 that correspond to the similar numbered components in the previous embodiment head visor 200 with the rear band 340 that attaches to rearwardly extending sides of the front head band 330 similar to the previous embodiments described. Hear the front head band 330 can include a solid smooth surface between the upper raised rim 334 and lower raised rim 326 (rear edge of brim) with a surface having not sockets (openings) therethrough, and the brim 320 can include a smooth solid contiguous surface between raised rims 322, 324, 326 also having no sockets (openings) therethrough.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A visor assembly, comprising:

a brim and a front headband formed from a soft, flexible and pliable EVA (ethylene vinyl acetate) material, the EVA material modified to be waterproof, floatable, antibacterial, temperature tough resistant, stress crack resistant, and UV (ultra violet) radiation resistant.

2. The visor assembly of claim 1, further comprising:

a separate removable rear headband strap having a first end for being attachable and detachable from the front headband, and a second end for being attachable and detachable from the front headband, the separate rear head band being molded from the soft, flexible and pliable EVA (ethylene vinyl acetate) material, the EVA material modified to be waterproof, floatable, antibacterial, temperature tough resistant, stress crack resistant, and UV (ultra violet) radiation resistant.

3. The visor assembly of claim 2, wherein the removable rear head band strap includes:

rivet members having inwardly protruding portions for being insertable into adjustment holes in the removable rear headband strap.

4. The visor assembly of claim 1, wherein the front headband includes: rearwardly facing ends, each having at least one adjustment hole for receiving the rivet members.

5. The visor assembly of claim 1, wherein the brim includes: a raised rim about an outer perimeter edge of the brim, the raised rim having a thickness and a width.

6. The visor assembly of claim 5, wherein the thickness of the raised rim is approximately 3/16 inch.

7. The visor assembly of claim 5, wherein the raised rim includes: a narrow width rim about side edges of the brim with a wider rim about a front portion of the brim.

8. The visor assembly of claim 7, wherein the narrow rim includes a width of approximately 0.11 inches and the wider rim having a width of approximately 0.38 inches.

9. The visor assembly of claim 1, wherein the front headband includes an upper raised rim and a lower raised rim parallel to the upper raised rim.

10. The visor assembly of claim 9, wherein the upper raised rim and the lower raised rim includes a thickness of approximately 1/4 inch.

11. The visor assembly of claim 2, wherein the rear headband strap includes an upper raised rim and a lower raised rim parallel to the upper raised rim, each rim having thickness and a width.

12. The visor assembly of claim 11, wherein the thickness of each raised rim is approximately 3/16 of an inch.

13. The visor assembly of claim 11, wherein the height of each raised rim is approximately 1/8 of an inch.

14. The visor assembly of claim 11, wherein each end of the rear headband includes a generally circular shape with a circular raised rim.

15. The visor assembly of claim 14, wherein the circular rear end includes a diameter of approximately 1 3/16 of an inch.

16. The visor assembly of claim 1, wherein the front headband includes a front facing portion, and rearwardly extending sides, wherein the front facing portion includes at least one opening across a front portion, and the brim includes an upper solid smooth surface with no openings and no slots therethrough.

17. The visor assembly of claim 16, wherein the front facing portion includes a plurality of openings for allowing at least one accessory to be attached thereto.

18. The visor assembly of claim 1, wherein the front headband includes a solid front facing smooth solid surface with no openings and no slots therethrough, and rearwardly extending sides, and the brim includes an upper solid smooth surface with no openings and no slots therethrough.

19. The visor assembly of claim 18, wherein the front headband includes an upper raised rim and a lower raised rim with a solid smooth surface therebetween having no openings and no slots therethrough.

20. An improved visor, comprising:

a front headband; and a brim extending from a lower portion of the front headband, the front headband and the brim being one piece and formed from a soft, flexible and pliable EVA (ethylene vinyl acetate) material, the EVA material modified to be waterproof, floatable, antibacterial, temperature tough resistant, stress crack resistant, and UV (ultra violet) radiation resistant.

* * * * *